US011796269B2

(12) United States Patent
Underwood et al.

(10) Patent No.: US 11,796,269 B2
(45) **Date of Patent: *Oct. 24, 2023**

(54) FIREARM OPERATING MECHANISMS AND BOLT RELEASE

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/671,027

(22) Filed: Feb. 14, 2022

(65) Prior Publication Data

US 2022/0170711 A1 Jun. 2, 2022

Related U.S. Application Data

(63) Continuation of application No. 16/815,993, filed on Mar. 11, 2020, now Pat. No. 11,280,570.

(60) Provisional application No. 62/816,476, filed on Mar. 11, 2019.

(51) Int. Cl.

| | |
|---|---|
| ***F41A 19/10*** | (2006.01) |
| ***F41A 19/25*** | (2006.01) |
| ***F41A 19/43*** | (2006.01) |
| *F41A 19/14* | (2006.01) |

(52) U.S. Cl.

CPC ..... *F41A 19/10* (2013.01); *F41A 19/25* (2013.01); *F41A 19/43* (2013.01); *F41A 19/14* (2013.01)

(58) Field of Classification Search

CPC ..... F41A 19/10; F41A 19/12; F41A 19/14; F41A 19/25; F41A 19/43; F41A 19/44; F41A 19/45; F41A 19/46

USPC ..... 42/69.01–69.3

See application file for complete search history.

(56) References Cited

U.S. PATENT DOCUMENTS

| | | | |
|---|---|---|---|
| 1,085,698 | A | 2/1914 | Nelson |
| 1,168,024 | A | 1/1916 | Nelson |
| 1,349,345 | A | 8/1920 | Payne |
| 2,182,693 | A | 12/1939 | Harton |
| 2,691,232 | A | 10/1954 | Toopes |
| 2,978,826 | A | 4/1961 | Ivy |
| 3,415,000 | A | 12/1968 | Koucky et al. |
| 3,715,826 | A | 2/1973 | Seifried |
| 4,031,648 | A | 6/1977 | Thomas |
| 4,246,830 | A | 1/1981 | Krieger |
| 4,420,899 | A | 12/1983 | Bourlet et al. |
| 4,521,985 | A | 6/1985 | Smith et al. |
| 4,549,465 | A | 10/1985 | Charron |
| 4,594,935 | A | 6/1986 | Smith |

(Continued)

*Primary Examiner* — Jonathan C Weber

(57) ABSTRACT

An operating system for a firearm includes a trigger, a hammer, a disconnector, a pivoting arm, and a lower member. The trigger includes a lower portion, an upper portion, and a trigger pivot. The disconnector includes a lower portion, an upper portion, and a disconnector pivot. The pivoting arm includes a forward protrusion, a pivoting arm opening, and a pin extending through the pivoting arm opening. The lower member includes a lower member opening and a pin hole that is coaxial with the trigger pivot and the disconnector pivot. At least a portion of the trigger and at least a portion of the disconnector are disposed within the lower member opening. Motion of the trigger causes the forward protrusion of the pivoting arm to engage a bolt carrier group and hold the bolt carrier group in an open position.

20 Claims, 17 Drawing Sheets

(56) References Cited

U.S. PATENT DOCUMENTS

| | | | |
|---|---|---|---|
| 4,619,062 | A | 10/1986 | Johnson |
| 4,742,634 | A | 5/1988 | Swenson |
| 4,815,226 | A | 3/1989 | Ruger |
| 4,915,011 | A | 4/1990 | Smith |
| 5,036,612 | A | 8/1991 | Jennings |
| 5,090,147 | A | 2/1992 | Pastor |
| 5,105,570 | A | 4/1992 | Lishness et al. |
| 5,299,374 | A | 4/1994 | Mathys |
| 5,386,659 | A | 2/1995 | Vaid et al. |
| 5,388,362 | A | 2/1995 | Melcher |
| 5,438,784 | A | 8/1995 | Lenkarski et al. |
| 5,537,769 | A | 7/1996 | Hargraves et al. |
| 5,640,794 | A | 6/1997 | Gardner et al. |
| 5,655,326 | A | 8/1997 | Levavi et al. |
| 5,741,996 | A | 4/1998 | Ruger et al. |
| 5,926,987 | A | 7/1999 | Novak |
| 6,073,380 | A | 6/2000 | Hauser et al. |
| 6,141,895 | A | 11/2000 | Rost et al. |
| 6,374,526 | B1 | 4/2002 | Mochak |
| 6,457,271 | B1 | 10/2002 | Vaid et al. |
| 6,655,066 | B2 | 12/2003 | Fluhr |
| 6,665,973 | B1 | 12/2003 | Peev |
| 6,820,606 | B1 | 11/2004 | Duffey |
| 6,880,281 | B1 | 4/2005 | Orr |
| 7,140,141 | B2 | 11/2006 | Vaid |
| 7,194,833 | B1 | 3/2007 | Curry |
| 7,243,452 | B2 | 7/2007 | Zeh |
| 7,263,796 | B2 | 9/2007 | Kellermann et al. |
| 7,516,570 | B2 | 4/2009 | Stone |
| 7,617,628 | B2 | 11/2009 | Curry |
| 7,703,230 | B2 | 4/2010 | Curry et al. |
| 7,810,268 | B1 | 10/2010 | McGarry |
| 7,810,269 | B2 | 10/2010 | Zukowski et al. |
| 7,861,449 | B1 | 1/2011 | Zajk |
| 7,866,077 | B2 | 1/2011 | Constant et al. |
| 7,930,848 | B2 | 4/2011 | Dye, Jr. |
| 7,958,661 | B2 | 6/2011 | Strayer |
| 8,015,742 | B2 | 9/2011 | Zedrosser |
| 8,033,043 | B2 | 10/2011 | McGarry |
| 8,112,926 | B2 | 2/2012 | Beretta |
| 8,117,779 | B2 | 2/2012 | Doll et al. |
| 8,122,634 | B2 | 2/2012 | Constant et al. |
| 8,191,298 | B2 | 6/2012 | Cash et al. |
| 8,220,193 | B1 | 7/2012 | Lynch |
| 8,250,799 | B2 | 8/2012 | Duperry et al. |
| 8,438,768 | B2 | 5/2013 | Kallio |
| 8,459,172 | B2 | 6/2013 | Landies et al. |
| 8,505,225 | B1 | 8/2013 | Degener |
| 8,572,878 | B2 | 11/2013 | Gentilini et al. |
| 8,601,932 | B1 | 12/2013 | Karfiol et al. |
| 8,656,619 | B2 | 2/2014 | Popikov |
| 8,667,881 | B1 | 3/2014 | Hawbaker |
| 8,683,725 | B2 | 4/2014 | Munson |
| 8,714,145 | B2 | 5/2014 | Maeda |
| 8,726,555 | B2 | 5/2014 | Carr |
| 8,776,426 | B1 | 7/2014 | Symonds |
| 8,820,211 | B1 | 9/2014 | Hawbaker |
| 8,863,425 | B2 | 10/2014 | Lee |
| 8,893,607 | B2 | 11/2014 | Audibert et al. |
| 8,925,232 | B2 | 1/2015 | Silveira |
| 8,935,872 | B2 | 1/2015 | Zukowski |
| 8,950,311 | B2 | 2/2015 | Emde et al. |
| 8,959,818 | B2 | 2/2015 | Mayerl |
| 9,062,925 | B1 | 6/2015 | Viani |
| 9,194,637 | B2 | 11/2015 | Mather |
| 9,303,936 | B2 | 4/2016 | Toner |
| 9,395,146 | B2 | 7/2016 | Tippmann, Jr. |
| 9,404,700 | B1 | 8/2016 | Viani |
| 9,410,758 | B1 | 8/2016 | Viani |
| 9,410,760 | B2 | 8/2016 | Siddle |
| 9,482,481 | B2 | 11/2016 | LaValley et al. |
| 9,541,341 | B2 | 1/2017 | Macy |
| 9,587,903 | B2 | 3/2017 | Sullivan et al. |
| RE46,411 | E | 5/2017 | Chu |
| 9,638,484 | B1 | 5/2017 | Friend |
| 9,777,980 | B2 | 10/2017 | Heizer |
| 9,803,943 | B2 | 10/2017 | Schafer et al. |
| 9,952,012 | B2 | 4/2018 | Fellows et al. |
| 9,952,013 | B2 | 4/2018 | Fellows et al. |
| 9,989,327 | B2 | 6/2018 | Horch |
| 10,001,332 | B1 | 6/2018 | Friend |
| 10,001,335 | B2 | 6/2018 | Patterson et al. |
| 10,101,102 | B2 | 10/2018 | Eitan et al. |
| 10,107,580 | B2 | 10/2018 | Fellows et al. |
| 10,393,461 | B2 | 8/2019 | Fellows et al. |
| 10,401,102 | B1 | 9/2019 | Carroll |
| 10,641,571 | B2 | 5/2020 | Quinn et al. |
| 10,739,095 | B2 | 8/2020 | Underwood et al. |
| 10,801,795 | B2 | 10/2020 | Lipowski |
| 10,845,147 | B2 | 11/2020 | Fellows et al. |
| 10,912,292 | B1 | 2/2021 | Maggiore |
| 11,280,570 | B2 | 3/2022 | Underwood et al. |
| 11,320,221 | B2 | 5/2022 | Kastrun |
| 11,421,954 | B2 | 8/2022 | Underwood et al. |
| 11,441,859 | B2 | 9/2022 | Underwood et al. |
| 2005/0132627 | A1 | 6/2005 | Wossner et al. |
| 2008/0078284 | A1 | 4/2008 | Murello |
| 2009/0158634 | A1 | 6/2009 | Bubits |
| 2010/0229447 | A1 | 9/2010 | Metzger |
| 2010/0287806 | A1 | 11/2010 | Marfione et al. |
| 2011/0232148 | A1 | 9/2011 | Cain et al. |
| 2011/0271827 | A1 | 11/2011 | Larson et al. |
| 2012/0174454 | A1 | 7/2012 | Kallio |
| 2012/0180354 | A1 | 7/2012 | Sullivan et al. |
| 2014/0215880 | A1 | 8/2014 | Zukowski |
| 2014/0311007 | A1 | 10/2014 | Capps et al. |
| 2015/0219413 | A1 | 8/2015 | Karimullah et al. |
| 2015/0253096 | A1 | 9/2015 | Lee |
| 2015/0267984 | A1 | 9/2015 | Kokinis et al. |
| 2015/0292828 | A1 | 10/2015 | Nebeker et al. |
| 2015/0308784 | A1 | 10/2015 | Cho |
| 2015/0068092 | A1 | 12/2015 | Kallio |
| 2015/0362274 | A1 | 12/2015 | Merlino et al. |
| 2016/0033218 | A1 | 2/2016 | Folkestad et al. |
| 2016/0047614 | A1 | 2/2016 | Larson, Jr. |
| 2016/0131449 | A1 | 5/2016 | Horch |
| 2016/0178303 | A1 | 6/2016 | Macy |
| 2016/0178304 | A1 | 6/2016 | Geissele |
| 2016/0187090 | A1 | 6/2016 | Mather et al. |
| 2016/0187092 | A1 | 6/2016 | Mather et al. |
| 2016/0377364 | A1 | 12/2016 | Santos Reis |
| 2017/0003093 | A1 | 1/2017 | Spinner et al. |
| 2017/0184366 | A1 | 6/2017 | Zajk et al. |
| 2017/0268843 | A1 | 9/2017 | Heizer |
| 2017/0328663 | A1 | 11/2017 | Fellows et al. |
| 2018/0112944 | A1 | 4/2018 | Underwood et al. |
| 2019/0271524 | A1 | 9/2019 | Khoshnood |
| 2020/0292266 | A1 | 9/2020 | Underwood et al. |
| 2020/0340769 | A1 | 10/2020 | Underwood et al. |
| 2021/0247157 | A1 | 8/2021 | Lesenfants |
| 2021/0270551 | A1 | 9/2021 | Underwood et al. |
| 2021/0348867 | A1 | 11/2021 | Reynolds et al. |
| 2022/0034615 | A1 | 2/2022 | Fellows et al. |
| 2022/0120526 | A1 | 4/2022 | Kim |
| 2022/0307788 | A1 | 9/2022 | Bender |
| 2022/0357122 | A1 | 11/2022 | Niswander et al. |
| 2022/0364812 | A1 | 11/2022 | Fellows |
| 2022/0364813 | A1 | 11/2022 | Underwood et al. |
| 2023/0143657 | A1 | 5/2023 | Underwood et al. |

FIREARM OPERATING MECHANISMS AND BOLT RELEASE

CROSS REFERENCE TO RELATED APPLICATIONS

This application is a continuation of U.S. patent application Ser. No. 16/815,993 ("the '993 application") filed Mar. 11, 2020, which is related to and claims priority benefit from U.S. Provisional Application No. 62/816,476 ("the '476 application"), filed on Mar. 11, 2019 and entitled "FIREARM OPERATING MECHANISMS AND BOLT RELEASE." The '993 application and the '476 application are each hereby incorporated in their entirety by this reference.

FIELD OF THE INVENTION

The field of the invention relates to firearms, particularly operating mechanisms and bolt release mechanisms for firearms.

BACKGROUND

Many firearms include operating systems that rely on gas pressure, rearward motion of a cartridge, other sources of energy, or combinations thereof to operate the firearm.

To simplify and/or reduce the speed of the operating system, it may be desirable to create at least one intermediate state or pause during the operating cycle. Such an intermediate state may facilitate more efficient cooling and/or cleaner operation.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, an operating system, which is disposed within a receiver of a firearm, comprises: a trigger comprising a lower portion, an upper portion, and a trigger pivot; a hammer comprising a hammer pivot; a disconnector comprising a lower portion, an upper portion, and a disconnector pivot; a pivoting arm comprising a forward protrusion, a pivoting arm opening, and a pin extending through the pivoting arm opening, wherein at least a portion of the hammer and at least a portion of the disconnector is disposed within the pivoting arm opening; a lower member comprising a lower member opening and a pin hole that is coaxial with the trigger pivot and the disconnector pivot, wherein at least a portion of the trigger and at least a portion of the disconnector is disposed within the lower member opening, wherein motion of the trigger causes the forward protrusion of the pivoting arm to engage a bolt carrier group of the firearm and hold the bolt carrier group in an open position.

DETAILED DESCRIPTION

Figure 1A:
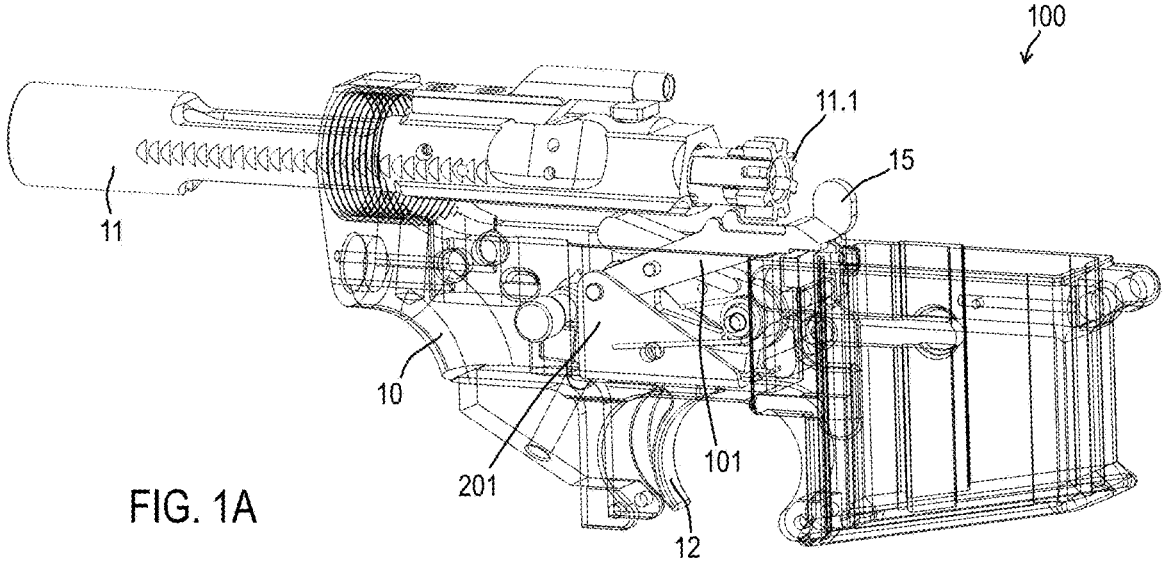
FIG. 1A is a front perspective view of an operating system for a firearm shown in context with a receiver, according to certain embodiments of the present invention.
Figure 1B:
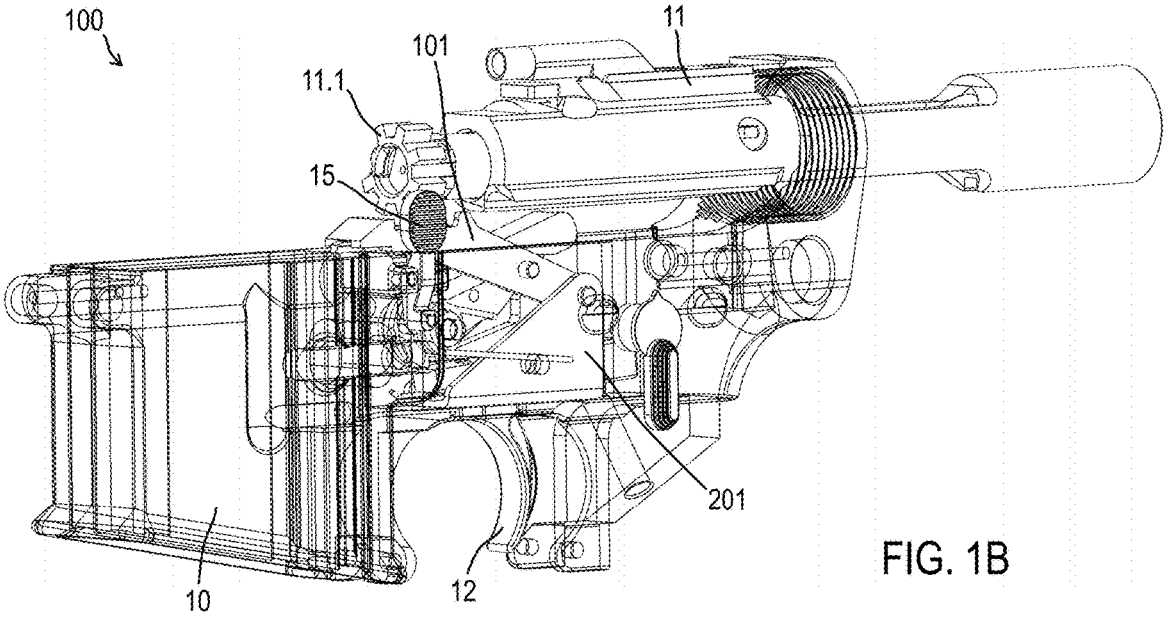
FIG. 1B is a front perspective view of the operating system of FIG. 1A shown in context with a receiver.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments focus on firearms and, in particular, AR-15 variant (civilian) or M16/M4 (military) firearms, the features, concepts, and functions described herein are also applicable (with potential necessary alterations for particular applications) to other assault rifles, rifles, carbines, shotguns, handguns, or any other type of firearm.

According to certain embodiments of the present invention, as shown in FIGS. 1A-15, an operating system 100 or an operating system 1000 may include a pivoting arm 101 (or a pivoting arm 1001) and a lower member 201 (or a lower member 2001). As shown in FIGS. 1A, 1B, 7A, and 7B, in some embodiments, the operating system may be fixed with respect to receiver 10 of a firearm (the receiver 10 is shown transparent in these views for ease of illustration). The receiver 10 may interface with a trigger 12, a hammer 13, and/or a disconnector 14. For example, the trigger 12, the hammer 13, and/or the disconnector 14 may function in a similar manner as described in "HYBRID MOLDED FIREARM ASSEMBLIES," U.S. application Ser. No. 15/720,218, filed on Sep. 29, 2017, the disclosure of which is incorporated herein in its entirety by this reference. In some embodiments, a trigger pin (such as a trigger pivot pin) may be inserted through a trigger pin hole of the receiver 10 such that the pin passes through pin hole 205 of the lower member 201, through pivot hole 12.1 of the trigger 12, and through pivot hole 14.1 of the disconnector 14 (see FIG. 5). In some cases, the trigger pin may be inserted through a trigger pin hole of the receiver 10 such that the pin passes through pin hole 2005 of the lower member 2001, through pivot hole 3002 of the disconnector plate 3001, through pivot hole 12.1 of the trigger 12, and through pivot hole 14.1 of the disconnector 14 (see FIG. 8C). A hammer pin (such as hammer pivot pin) may be inserted through a hammer pin hole of the receiver 10 such that the pin passes through pivot hole 13.1 of the hammer 13 (see FIG. 5). In some cases, the hammer pin may be inserted through a hammer pin hole of the receiver 10 such that the pin passes through forward pivot hole 2006 of the lower member 2001 and through pivot hole 13.1 of the hammer 13 (see FIG. 8C). The receiver 10 may also interface with a bolt release 15, which rotates about a hole 15.1, and a safety selector 16.

In some embodiments, the operating system 100 and/or the operating system 1000 may include a temporary trigger pin and/or a temporary hammer pin. In some cases, the temporary pin(s) may be inserted through the various components and the lower member 201 (or lower member 2001) to secure the components outside of a receiver 10. The operating system 100 (or the operating system 1000) may be inserted into a receiver 10 with the temporary pin(s) installed. To secure the operating system 100 (or the operating system 1000), after the operating system is inserted into the receiver 10, the temporary pin(s) may each be replaced with a pin that engages all of the relevant components, including the receiver 10. In some embodiments, the temporary pin(s) are plastic.

Figure 2A:
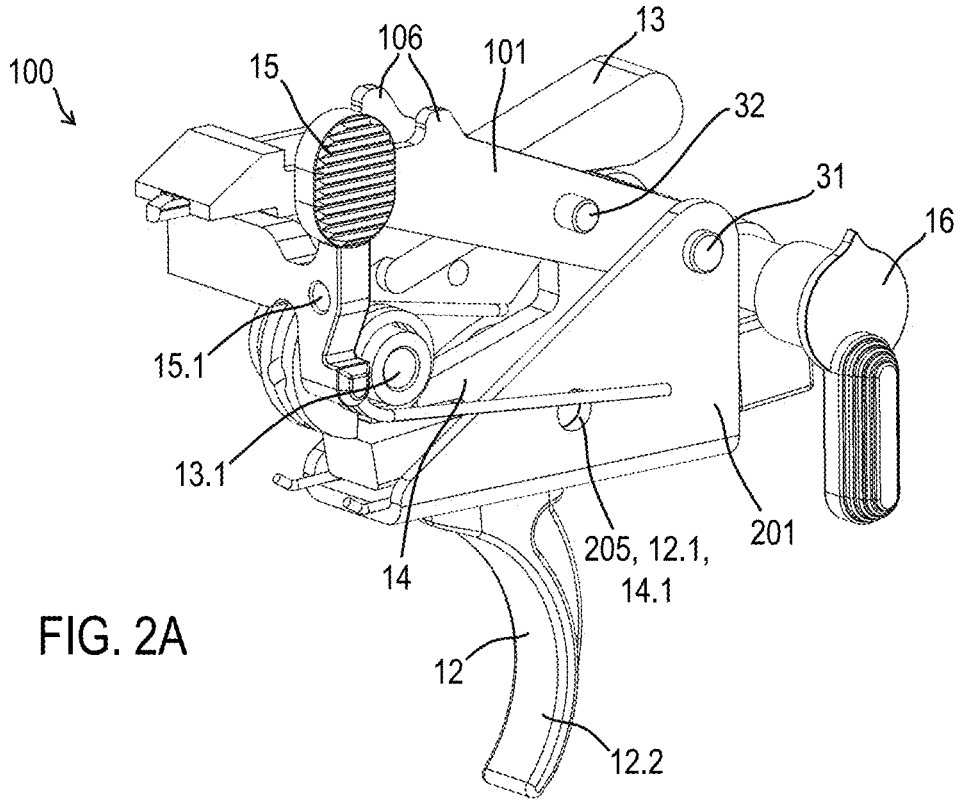
FIGS. 2A and 2B are front perspective views of the operating system of FIG. 1A.
Figure 2B:
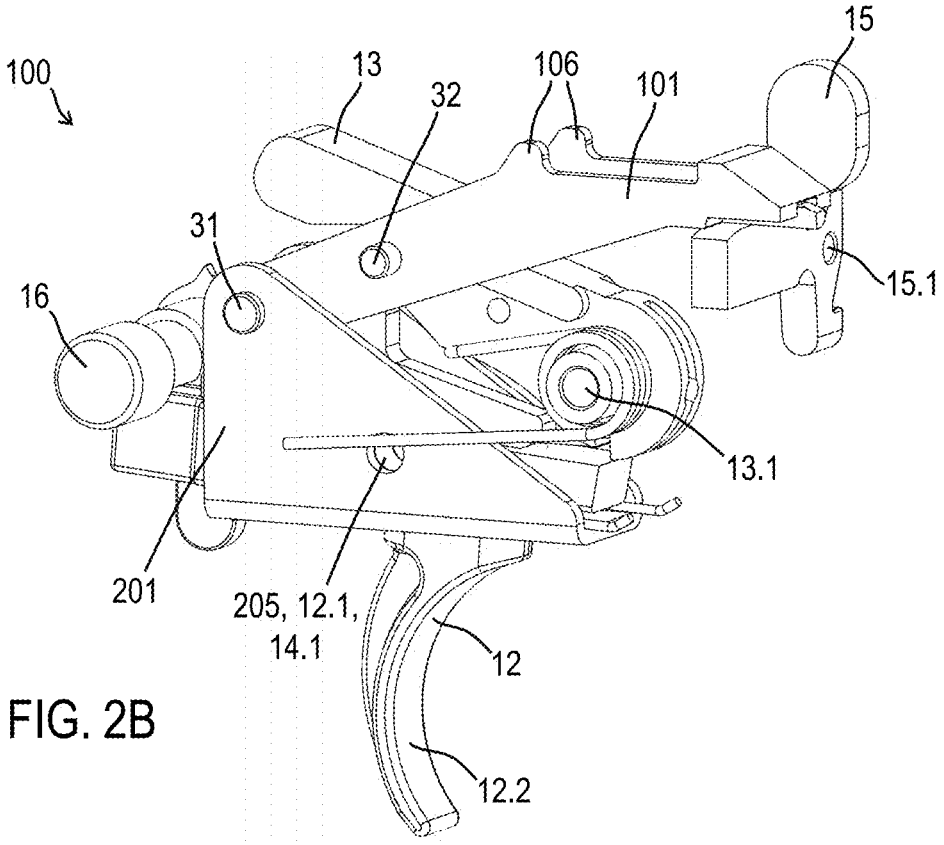
Figure 3A:
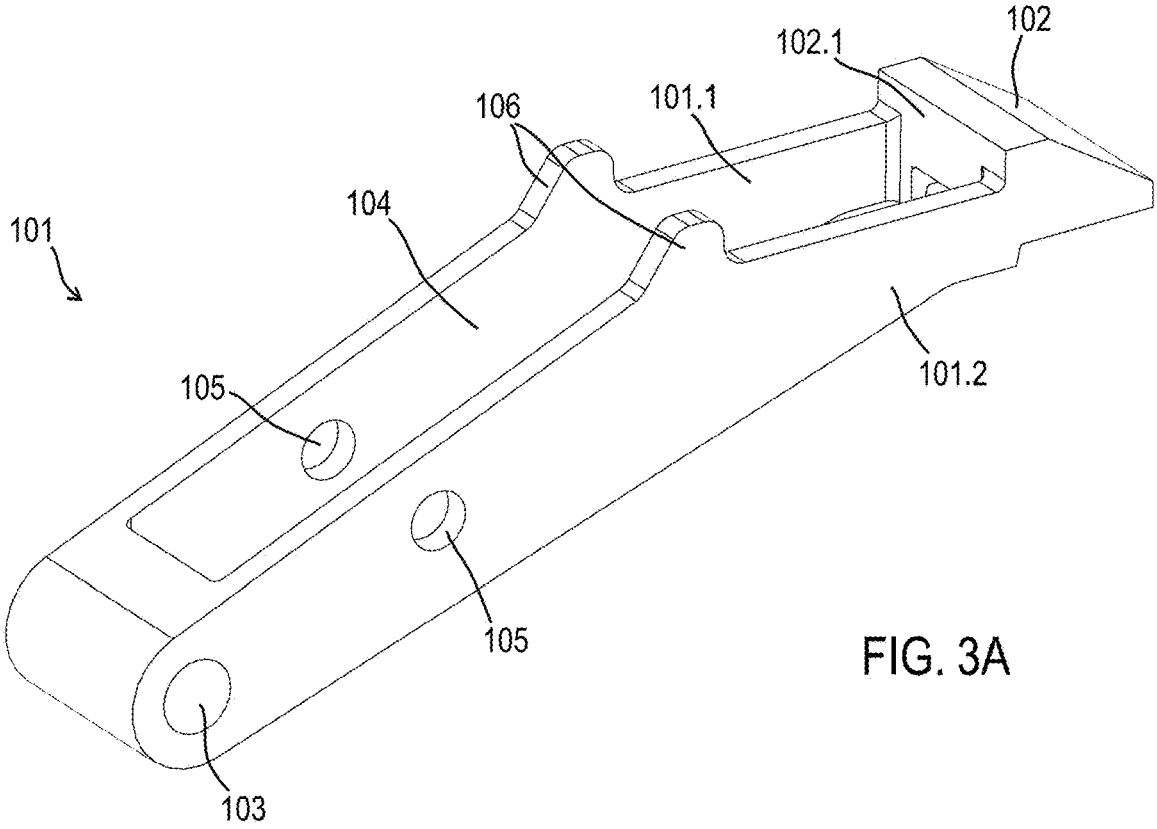
FIG. 3A is a top perspective view of a pivoting arm of the operating system of FIG. 1A.
Figure 3B:
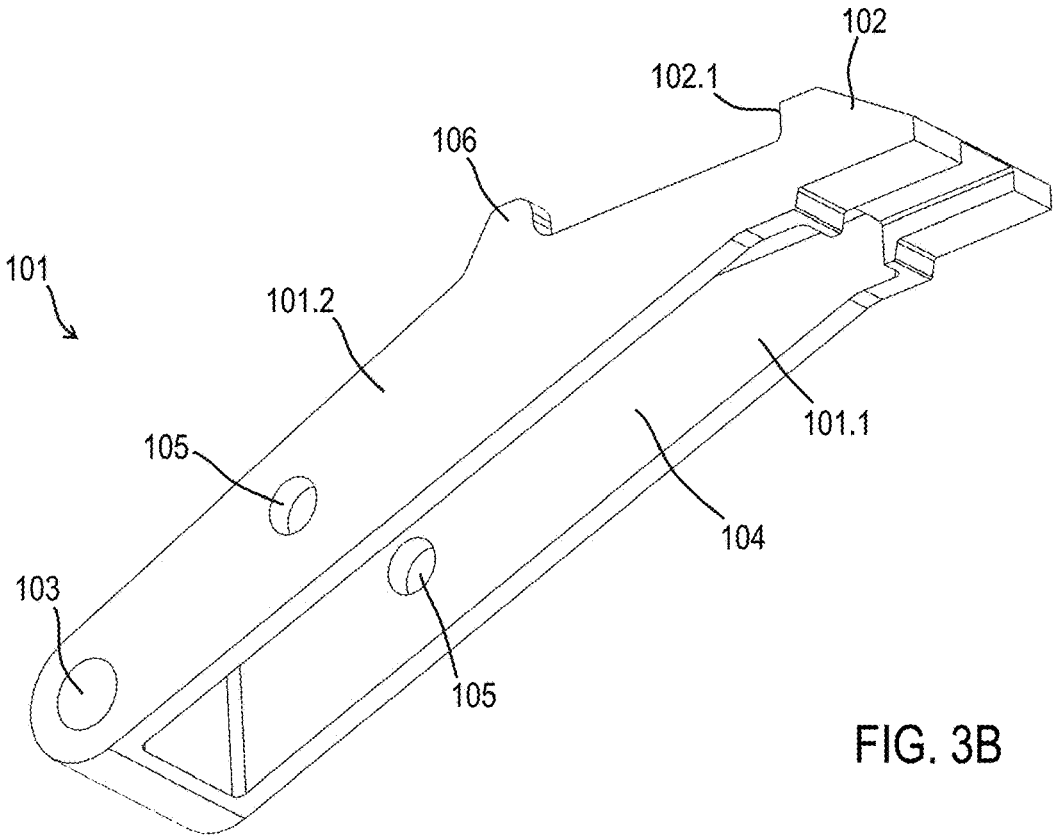
FIG. 3B is a bottom perspective view of the pivoting arm of FIG. 3A.
Figure 4A:
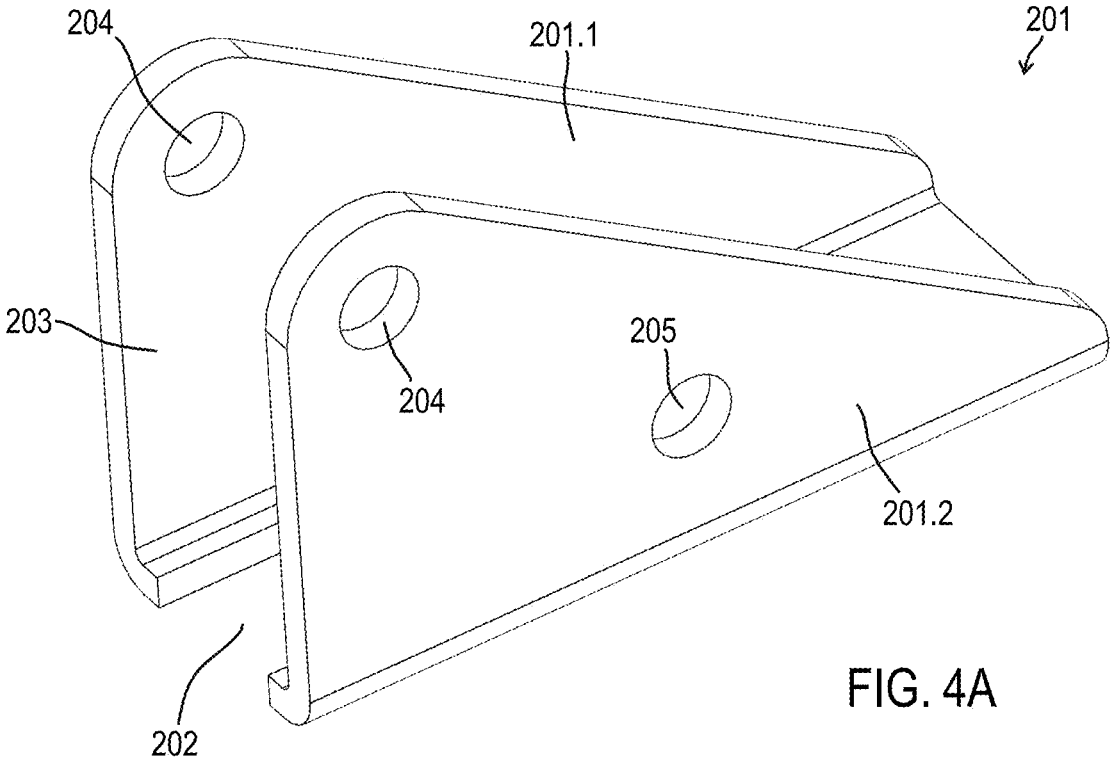
FIG. 4A is a top perspective view of a lower member of the operating system of FIG. 1A.
Figure 4B:
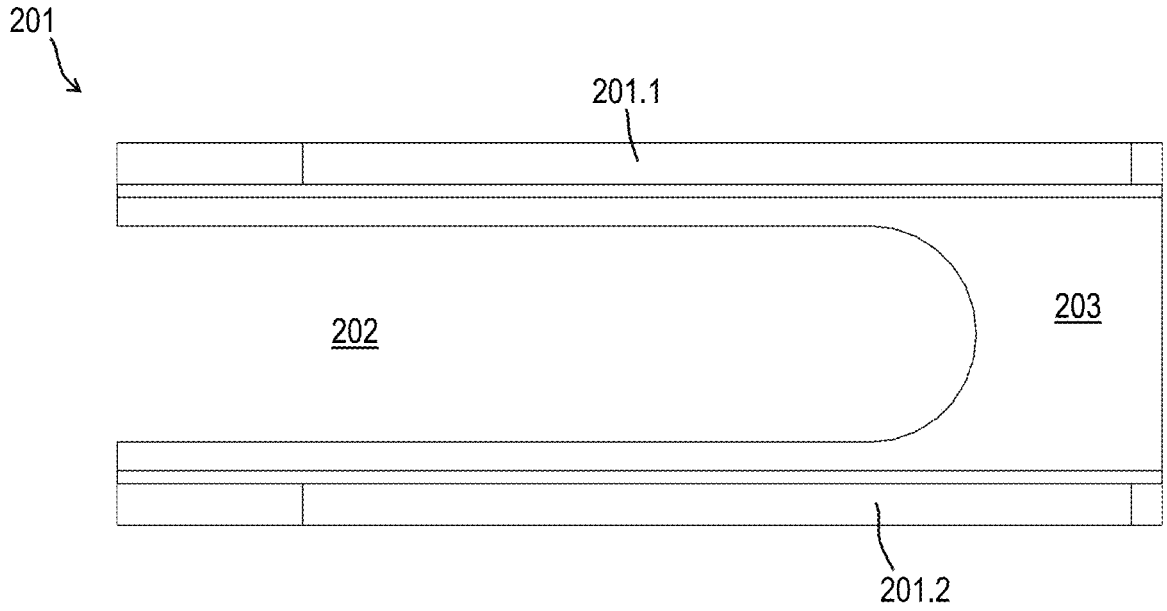
FIG. 4B is a top view of the lower member of FIG. 4A.

For operating system 100, the pivoting arm 101 may be attached to the lower member 201. For example, as shown in FIGS. 2A and 2B, the pivoting arm 101 may be rotatably attached to the lower member 201 by a rotation pin 31 where the rotation pin 31 passes through pivot hole 204 of the lower member 201 (see FIG. 4A) and through pivot hole 103 of the pivoting arm 101 (see FIGS. 3A and 3B). In some embodiments, the pivoting arm 101 includes a forward protrusion 102 along with a left arm 101.1 and a right arm 101.2 that are separated from one another by an opening 104. The left and right arms 101.1, 101.2 may each include an upward protrusion 106. A hole 105 may extend through both left arm 101.1 and right arm 101.2, and a pin 32 may be inserted through hole 105 (see FIGS. 2A and 2B). The lower member 201 may include a left wall 201.1 and a right wall 201.2 that are separated from one another by an opening 203. In some embodiments, as shown in FIGS. 2A and 2B, at least a portion of the pivoting arm 101 is disposed within the opening 203 of the lower member 201 such that the outer surface of the left arm 101.1 is disposed adjacent to the inner surface of the left wall 201.1 and the outer surface of the right arm 101.2 is disposed adjacent to the inner surface of the right wall 201.2.

Figure 5:
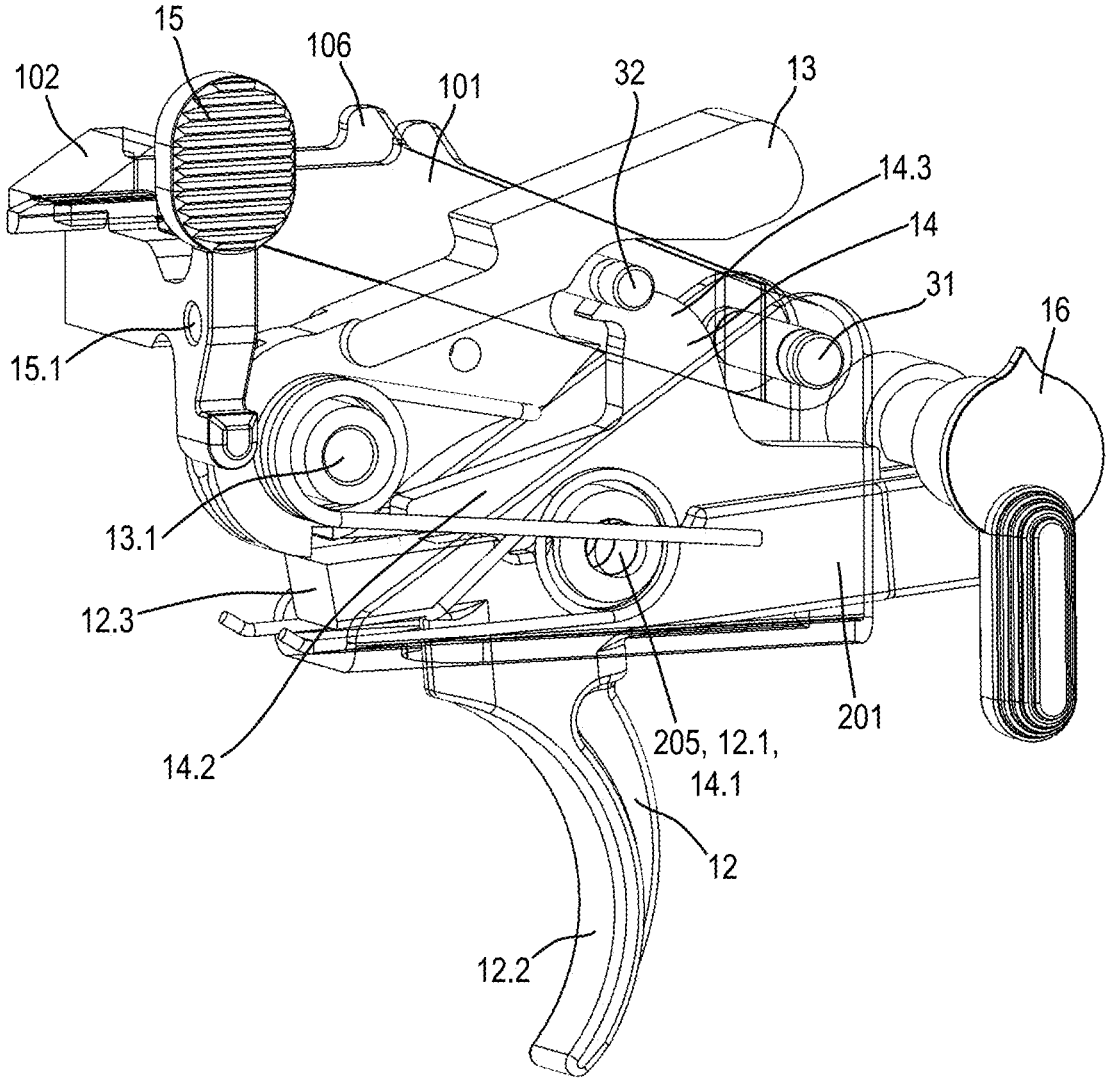
FIG. 5 is a front perspective view of the operating system of FIG. 1A.

In some embodiments, at least portions of the trigger 12, the hammer 13, and/or the disconnector 14 are disposed within the pivoting arm 101 and/or the lower member 201 (see FIGS. 2A and 2B). For example, at least a portion of the hammer 13 may be disposed within the opening 104 of the pivoting arm 101 when the hammer 13 is in the rear (or reset) position as shown in FIGS. 2A, 2B, and 5. The pivoting arm 101 and the lower member 201 are shown transparent in FIG. 5 for ease of illustration. A portion of the hammer 13 may also be at least partially disposed within the opening 104 of the pivoting arm 101 when the hammer 13 is in the forward position (see FIG. 6B). The disconnector 14 may include a lower portion 14.2 that is at least partially disposed in the opening 203 of the lower member 201 and an upper portion 14.3 that is at least partially disposed within the opening 104 of the pivoting arm 101 (see FIG. 5). The trigger 12 may include a lower portion 12.2 that extends through the hole 202 of the lower member 201 (such that at least part of lower portion 12.2 is disposed below the lower member 201) and an upper portion 12.3 that is at least partially disposed within the opening 203 of the lower member 201 (see FIG. 5).

Figure 6A:
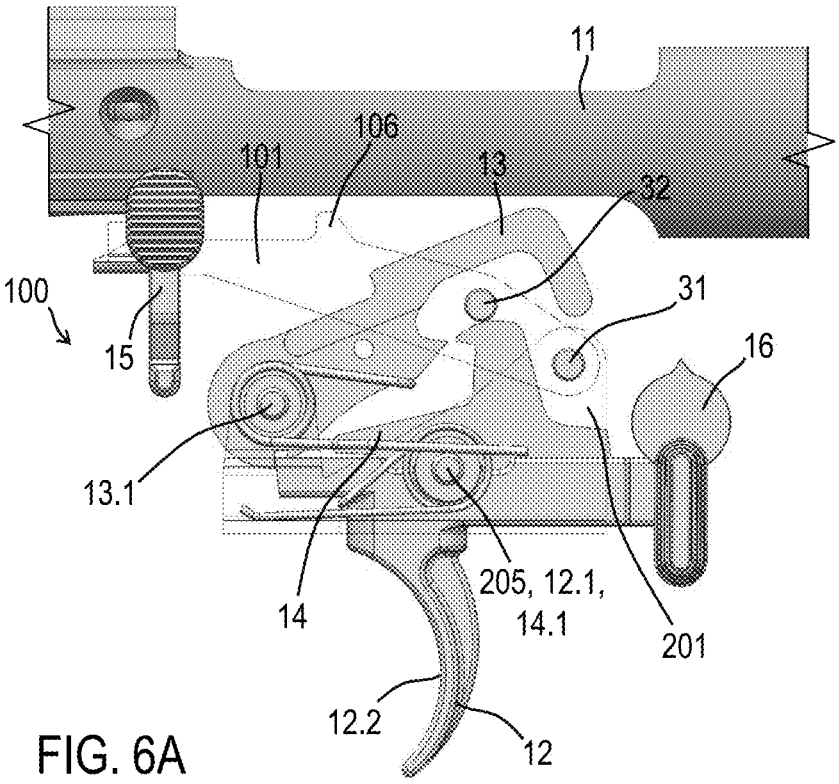
FIG. 6A is a side view of the operating system of FIG. 1A in a first condition.
Figure 6B:
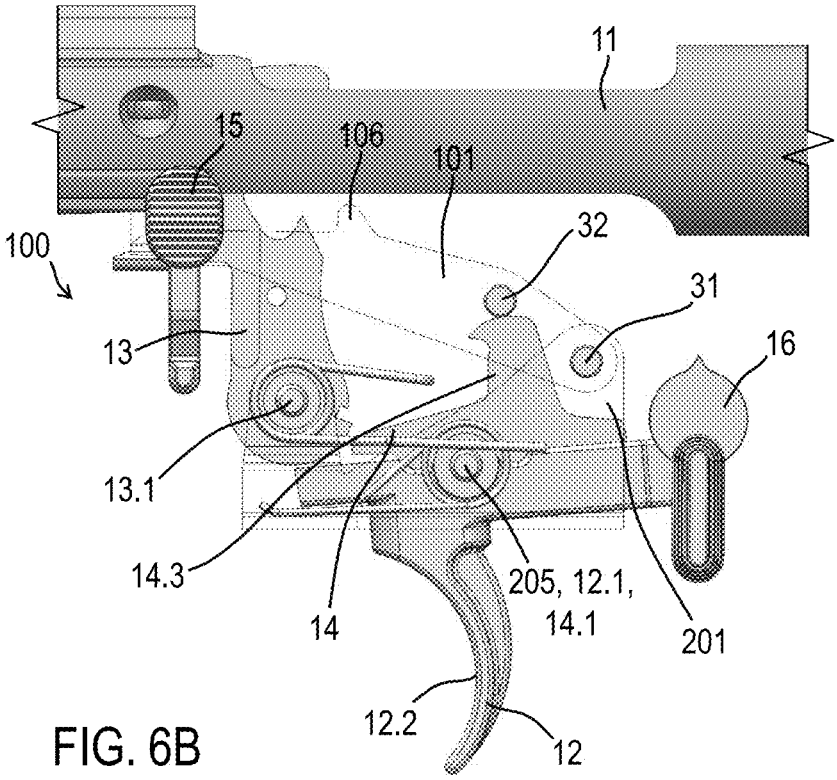
FIG. 6B is a side view of the operating system of FIG. 1A in a second condition.

Various conditions of the operating system 100 are illustrated in FIGS. 6A-6D, which show a view from the left side of the firearm. In FIG. 6A, the operating system 100 is in a first condition where (assuming a cartridge is in the chamber, which is not shown) the safety selector 16 is in a fire position and the firearm is ready to fire. As shown in FIG. 6B (second condition) an operator can actuate the trigger 12 by pressing the lower portion 12.2 counter-clockwise about pivot hole 12.1 (as viewed from the left side as shown in FIGS. 6A-6D), which disengages the trigger 12 from the hammer 13 such that the hammer 13 rotates counter-clockwise about pivot hole 13.1 such that the hammer 13 contacts a firing pin (not shown). FIG. 6B shows the operating system 100 at the moment the hammer 13 reaches the forward position while the trigger 12 is held in the rearward position (before the bolt carrier group 11 moves rearward). The rotation of the trigger 12 may also rotate disconnector 14 about pivot hole 14.1 such that upper portion 14.3 bears against and begins pushing upward on pin 32. Upward pressure on pin 32 may cause the pivoting arm 101 to rotate clockwise about rotation pin 31.

Figure 6C:
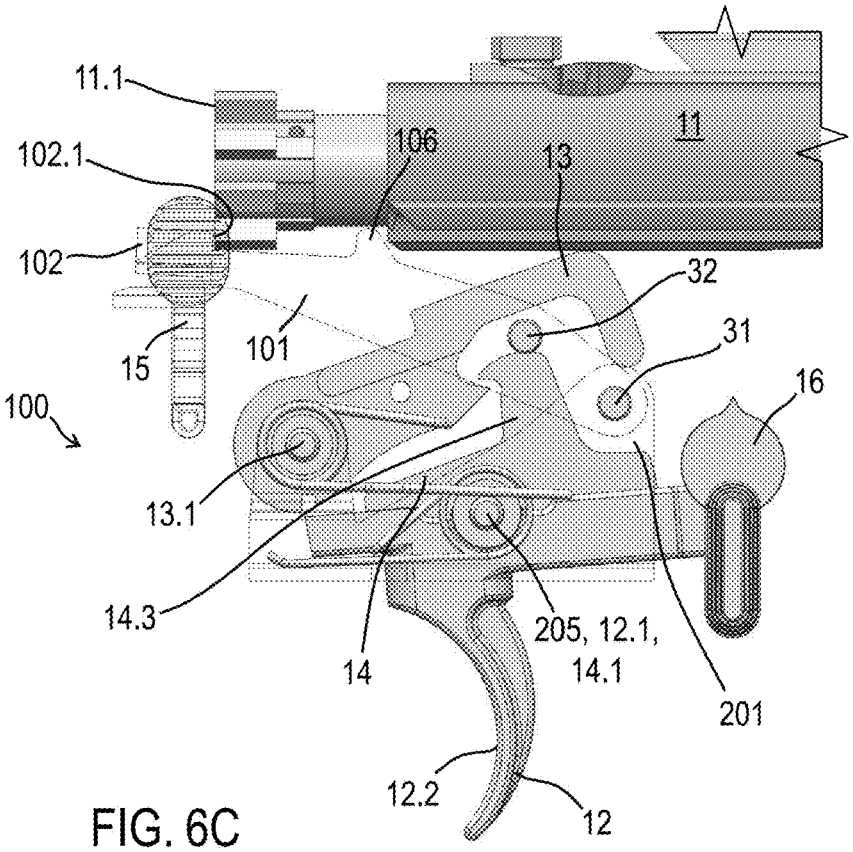
FIG. 6C is a side view of the operating system of FIG. 1A in a third condition.

FIG. 6C shows the bolt carrier group 11 after it has moved to a rear position (due to gas pressure caused by firing a cartridge) such that rearward movement of the bolt carrier group 11 pushes and causes the hammer 13 to rotate about pivot hole 13.1 to a rearward position. The operator continues to hold the lower portion 12.2 of the trigger 12 in a rearward position (see FIG. 6C), which causes the disconnector 14 to pivot with the trigger 12 (about hole 14.1) such that upper portion 14.3 pushes upward on pin 32. The operating system 100 may be designed to hold the bolt carrier group 11 in a rear (open) position. In some embodiments, as the bolt carrier group 11 moves rearward (i.e., movement between the position shown in FIG. 6B and FIG. 6C), the upward protrusions 106 contact the underside of the bolt carrier group 11 to ensure the surface 102.1 of forward protrusion 102 does not engage any portion of the bolt carrier group 11 other than the leading surface 11.1. Upward pressure on pin 32 causes the pivoting arm 101 to rotate clockwise about rotation pin 31 such that surface 102.1 of forward protrusion 102 interfaces with leading surface 11.1 of the bolt. In other embodiments, the operating system 100 may engage other portions of the bolt carrier group 11 to secure it in the rear (open) position. FIG. 6C illustrates a third condition where holding the trigger 12 in a rearward position causes the pivoting arm 101 to engage and hold the bolt carrier group 11 in the rear (open) position. This is different than a typical conventional firearm where the bolt carrier group 11 would move rearward (due to gas pressure) and immediately return to a forward position regardless of the position of the trigger. The buffer spring (not shown) provides pressure to push the bolt carrier group 11 back toward the forward position. However, for operating system 100 (and operating system 1000), when the bolt carrier group 11 is located in the rear position, the pivoting arm 101 (or the pivoting arm 1001) holds the bolt carrier group 11 rearward until the operator performs an additional action. As described below, the additional action may be releasing the trigger 12 (for operating system 100), actuating the trigger 12 a second time (for operating system 1000), or any other appropriate action.

Figure 6D:
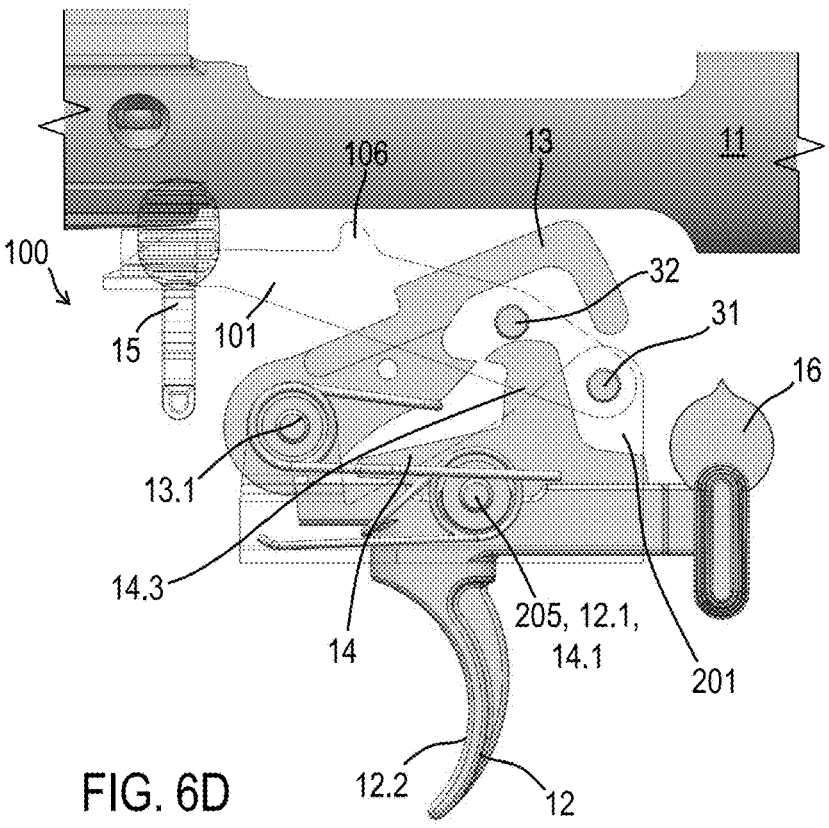
FIG. 6D is a side view of the operating system of FIG. 1A in a fourth condition.

The operator has released the trigger 12 allowing the trigger 12 to rotate clockwise about pivot hole 12.1 back to a typical position in FIG. 6D. Clockwise rotation of the trigger 12 also rotates the disconnector 14 clockwise about pivot hole 14.1 such that the upper portion 14.3 moves down. Downward movement of the upper portion 14.3 eliminates any upward pressure on pin 32, which allows the pivoting arm 101 to rotate counter-clockwise about rotation pin 31 such that forward protrusion 102 moves down thus disengaging from and allowing the bolt carrier group 11 to move forward. In other words, FIG. 6D returns the firearm back to a condition similar to FIG. 6A. The firearm is then ready to fire a subsequent round such that the operator may press the lower portion 12.2 causing the trigger 12 to rotate (as described above).

Figure 7A:
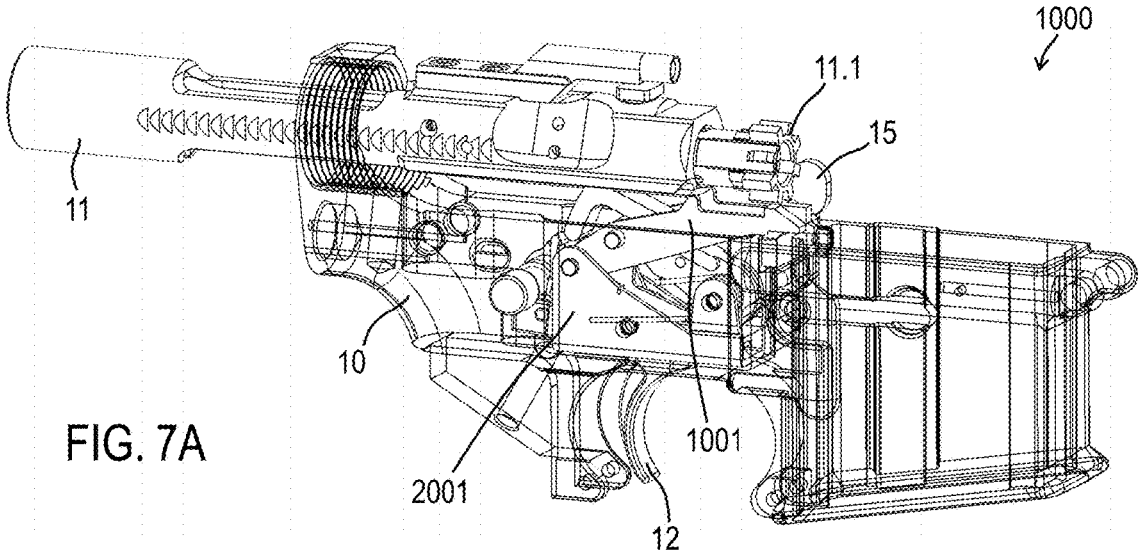
FIG. 7A is a front perspective view of an operating system for a firearm shown in context with a receiver, according to certain embodiments of the present invention.
Figure 7B:
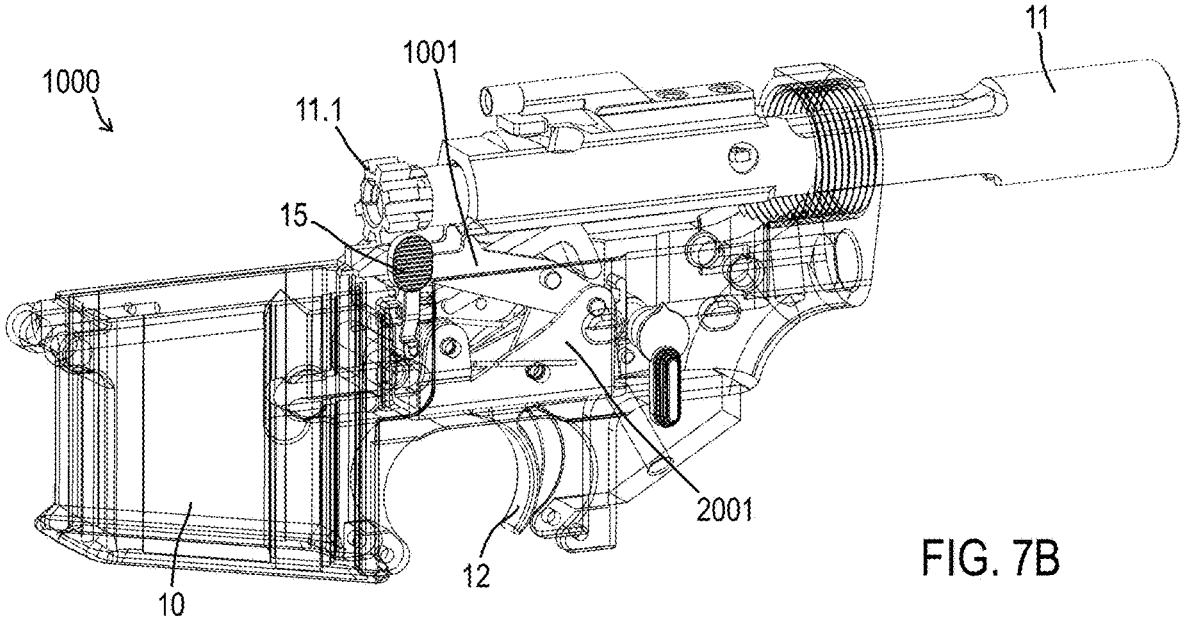
FIG. 7B is a front perspective view of the operating system of FIG. 7A shown in context with a receiver.

According to certain embodiments of the present invention, as shown in FIGS. 7A-15, an operating system 1000 may include a pivoting arm 1001, a lower member 2001, a disconnector plate 3001, a cam 4001, and a reset arm 5001. As shown in FIGS. 7A and 7B, in some embodiments, the operating system 1000 may be fixed with respect to receiver 10 of a firearm (the receiver 10 is shown transparent in these views for ease of illustration). The receiver 10, along with other components (such as the trigger 12, a hammer 13, and/or a disconnector 14) function in a similar manner as described above in the context of operating system 100. In some embodiments, a pin (such as a trigger pivot pin) may be inserted through a trigger pin hole of the receiver 10 such that the pin passes through pin hole 2005 of the lower member 2001, through pivot hole 3002 of the disconnector plate 3001, through pivot hole 12.1 of the trigger 12, and through pivot hole 14.1 of the disconnector 14.

Figure 8A:
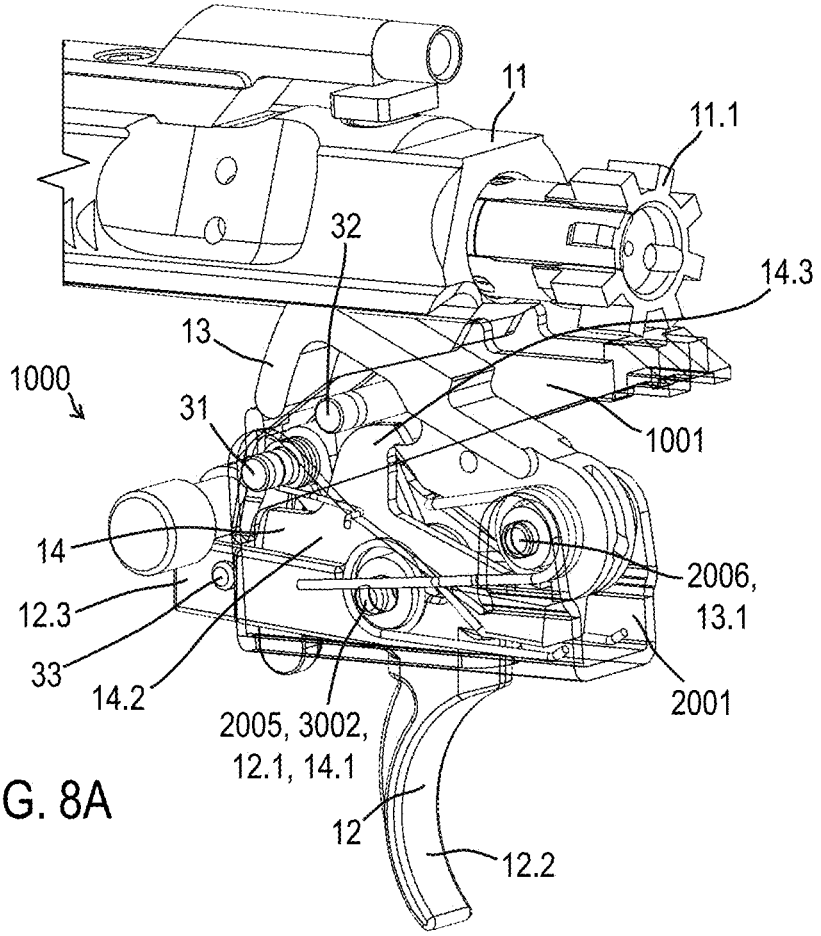
FIGS. 8A, 8B, and 8C are front perspective views of the operating system of FIG. 7A.
Figure 8B:
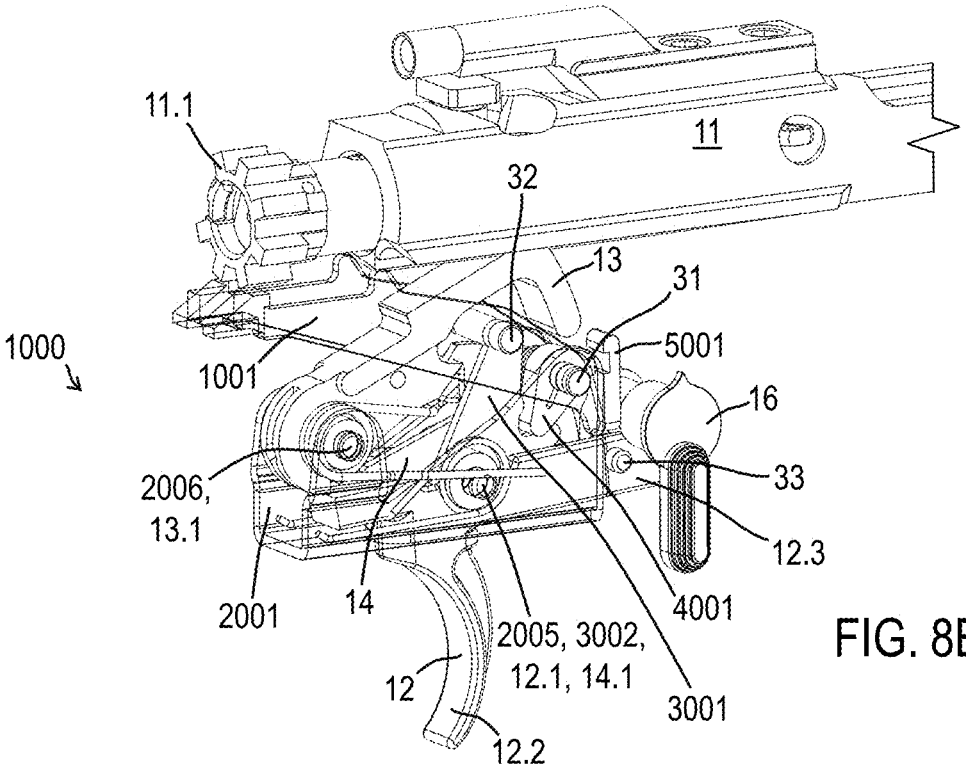
Figure 8C:
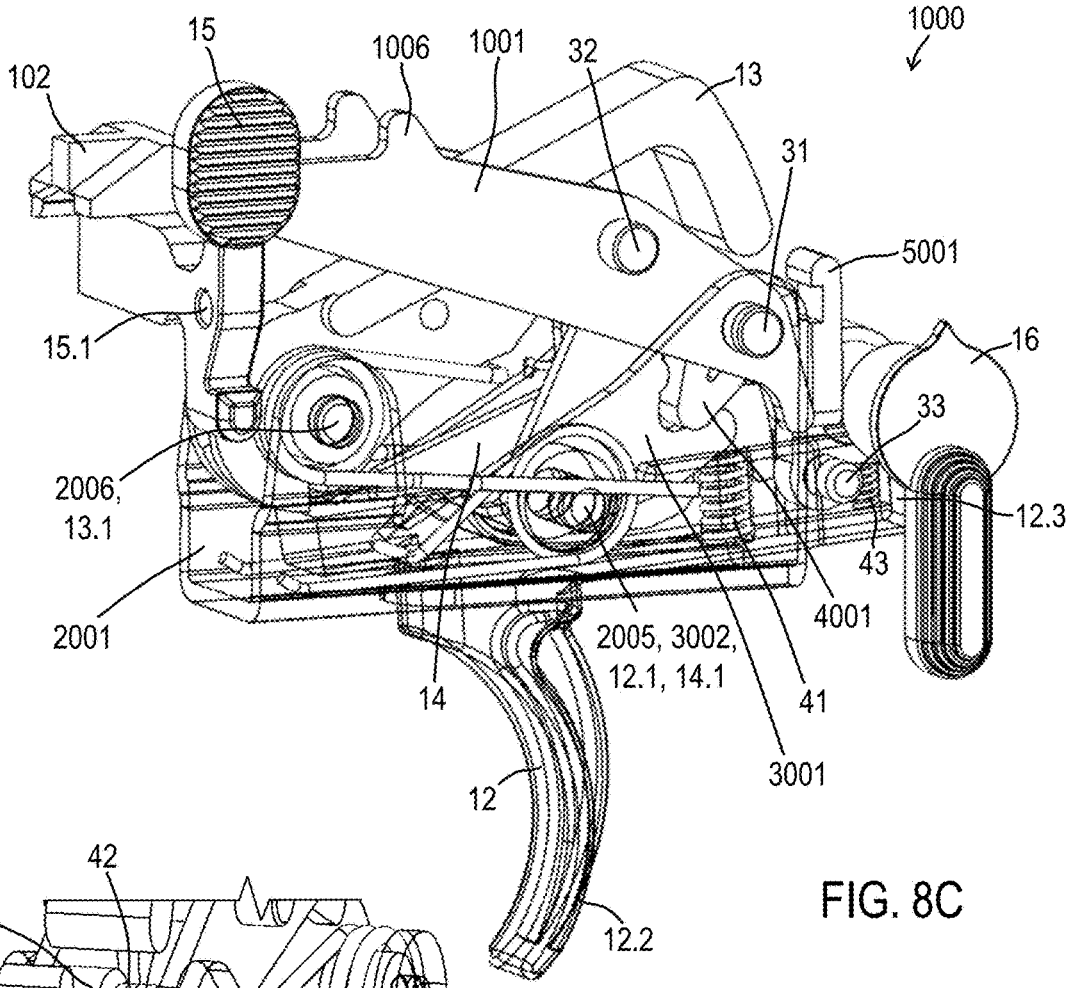
Figure 8D:
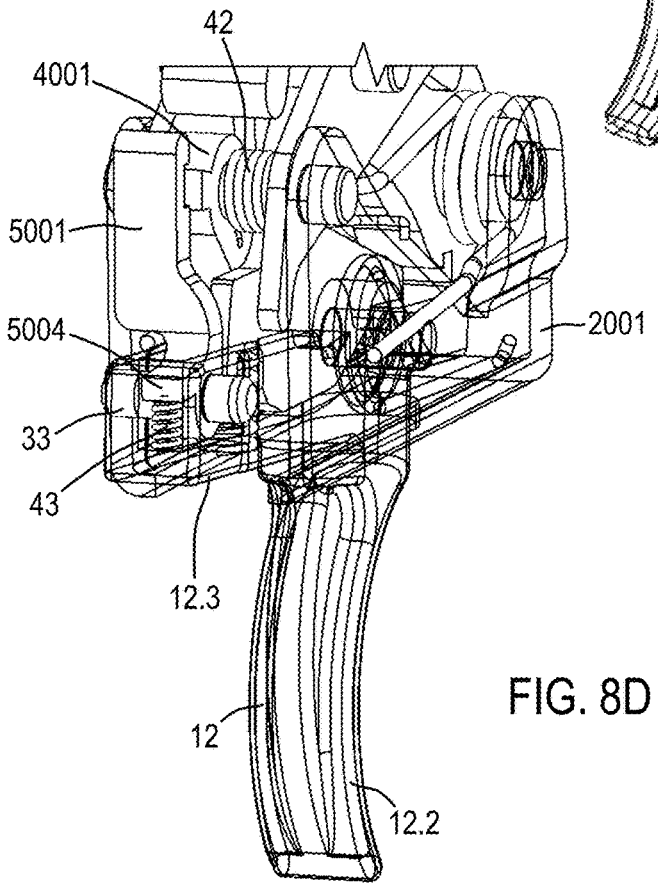
FIG. 8D is a rear perspective view of the operating system of FIG. 7A.
Figure 9A:
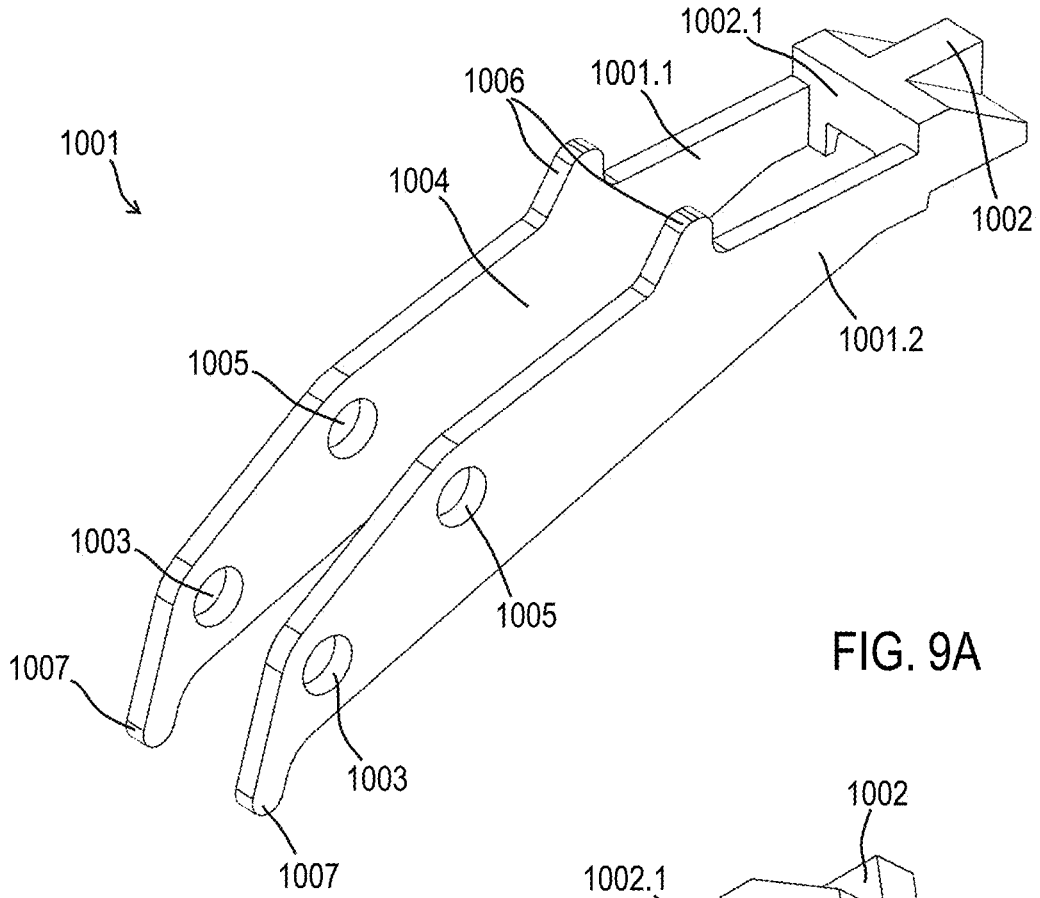
FIG. 9A is a top perspective view of a pivoting arm of the operating system of FIG. 1A.
Figure 9B:
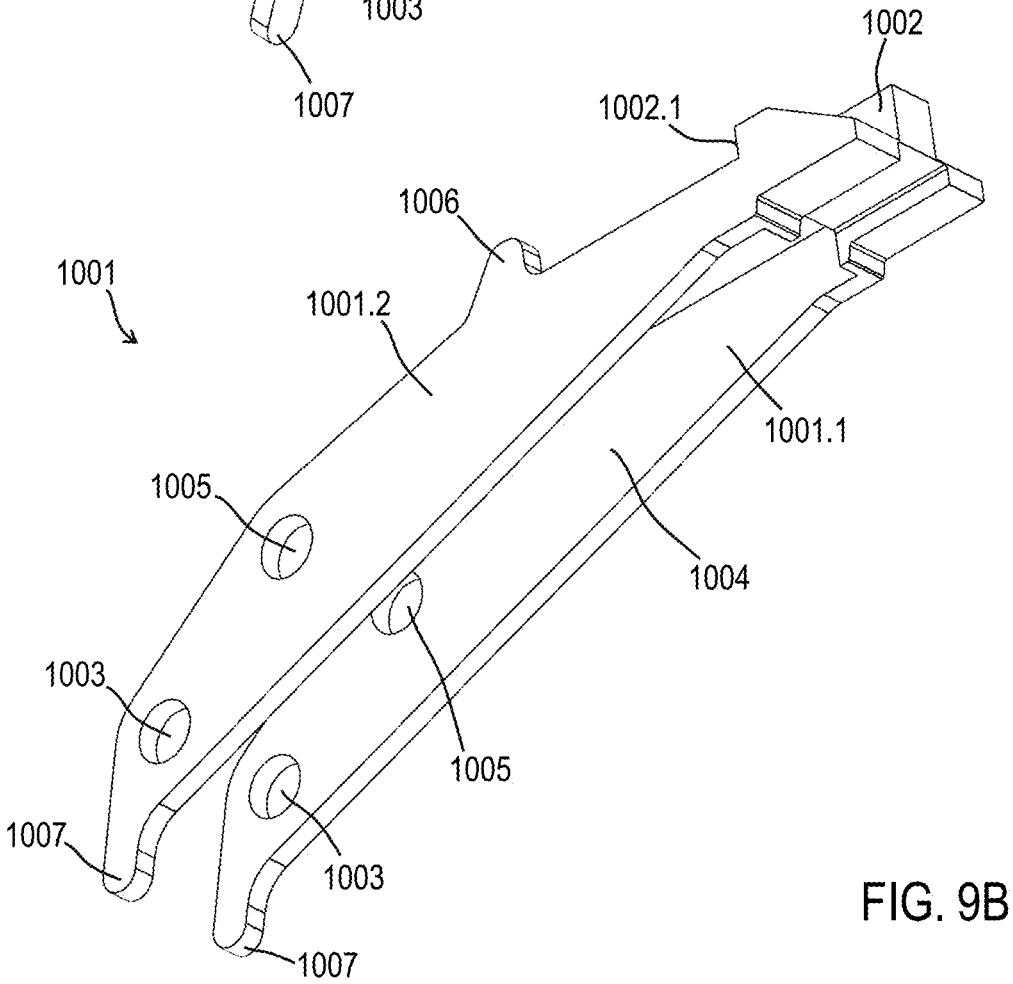
FIG. 9B is a bottom perspective view of the pivoting arm of FIG. 9A.
Figure 10A:
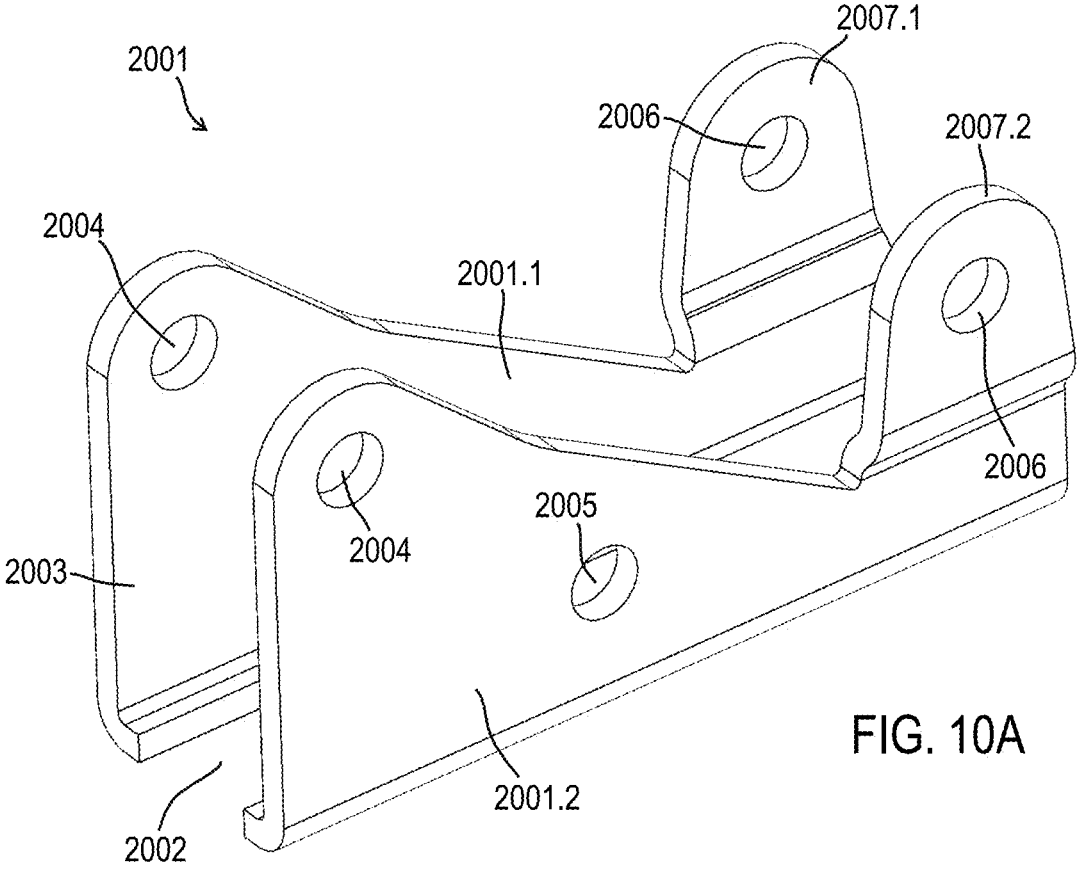
FIG. 10A is a top perspective view of a lower member of the operating system of FIG. 7A.
Figure 10B:
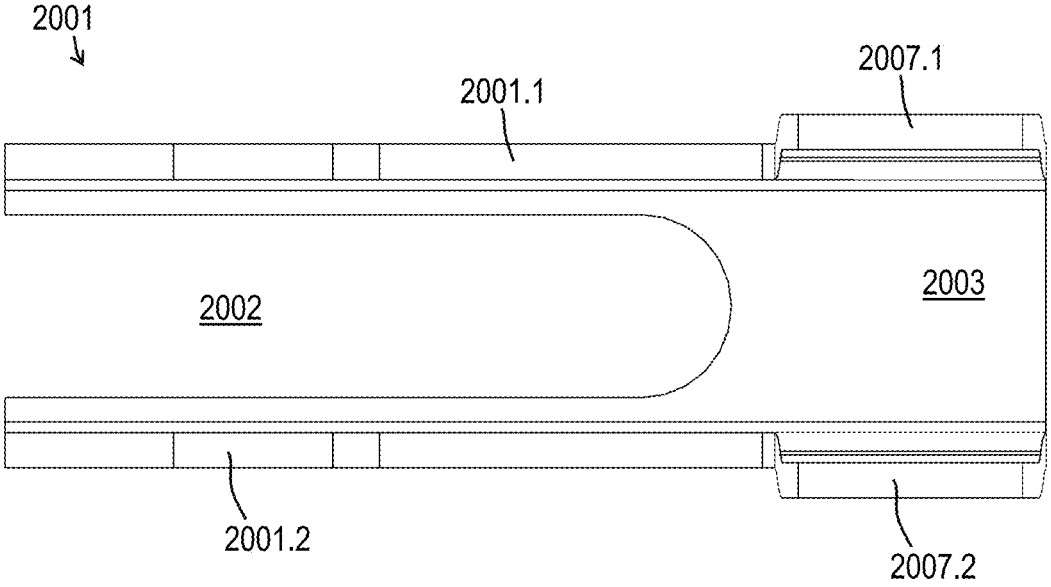
FIG. 10B is a top view of the lower member of FIG. 10A.

The pivoting arm 1001 may be attached to the lower member 2001. In some cases, the cam 4001 is also attached to the lower member 2001 and pivoting arm 1001. For example, as shown in FIGS. 8A-8C, the pivoting arm 1001 and the cam 4001 may be rotatably attached to the lower member 2001 by a rotation pin 31 where the rotation pin 31 passes through rear pivot hole 2004 of the lower member 2001 (see FIGS. 8A-8C and 10A), through pivot hole 1003 of the pivoting arm 1001 (see FIGS. 9A and 9B), and through pivot hole 4002 of the cam 4001. The pivoting arm 1001 and the lower member 2001 are shown transparent in FIGS. 8A and 8B for ease of illustration. The trigger 12 and the lower member 2001 are shown transparent in FIGS. 8C and 8D for ease of illustration.

As shown in FIGS. 9A-10B, in some embodiments, the pivoting arm 1001 includes a forward protrusion 1002 along with a left arm 1001.1 and a right arm 1001.2 that are separated from one another by an opening 1004. The left and right arms 1001.1, 1001.2 may each include an upward protrusion 1006 and a rear protrusion 1007. A hole 1005 may extend through both left arm 1001.1 and right arm 1001.2, and a pin 32 may be inserted through hole 1005 (see FIGS. 8A and 8B). The lower member 2001 may include a left wall 2001.1 and a right wall 2001.2 that are separated from one another by an opening 2003. The lower member 2001 may also include a forward left protrusion 2007.1 and a forward right protrusion 2007.2 that include a forward pivot hole 2006. In some embodiments, the forward pivot hole 2006 is coaxial with pivot hole 13.1 of the hammer 13. In other words, a pin can pass through the receiver 10, through forward pivot hole 2006, and through pivot hole 13.1 of the hammer 13.

In some embodiments, as shown in FIGS. 8A-8C, at least a portion of the pivoting arm 1001 is disposed within the opening 2003 of the lower member 2001 such that the outer surface of the left arm 1001.1 is disposed adjacent to the inner surface of the left wall 2001.1 and the outer surface of the right arm 1001.2 is disposed adjacent to the inner surface of the right wall 2001.2.

At least portions of the trigger 12, the hammer 13, and/or the disconnector 14 may be disposed within the pivoting arm 1001 and/or the lower member 2001 (see FIGS. 8A and 8B). For example, (i) a lower portion of the hammer 13 is disposed between the forward left protrusion 2007.1 and the forward right protrusion 2007.2 of the lower member 2001 and (ii) at least a portion of the hammer 13 may be disposed within the opening 1004 of the pivoting arm 1001 when the hammer 13 is in the rear (or reset) position as shown in FIGS. 7A-8B. A portion of the hammer 13 may also be at least partially disposed within the opening 1004 of the pivoting arm 1001 when the hammer 13 is in the forward position (see FIG. 14B). The disconnector 14 may include a lower portion 14.2 that is at least partially disposed in the opening 2003 of the lower member 2001 and an upper portion 14.3 that is at least partially disposed within the opening 1004 of the pivoting arm 1001 (see FIG. 8A). The trigger 12 may include a lower portion 12.2 that extends through the hole 2002 of the lower member 2001 (such that at least part of lower portion 12.2 is disposed below the lower member 2001) and an upper portion 12.3 that is at least partially disposed within the opening 2003 of the lower member 2001 (see FIGS. 8A and 8B).

Figure 11:
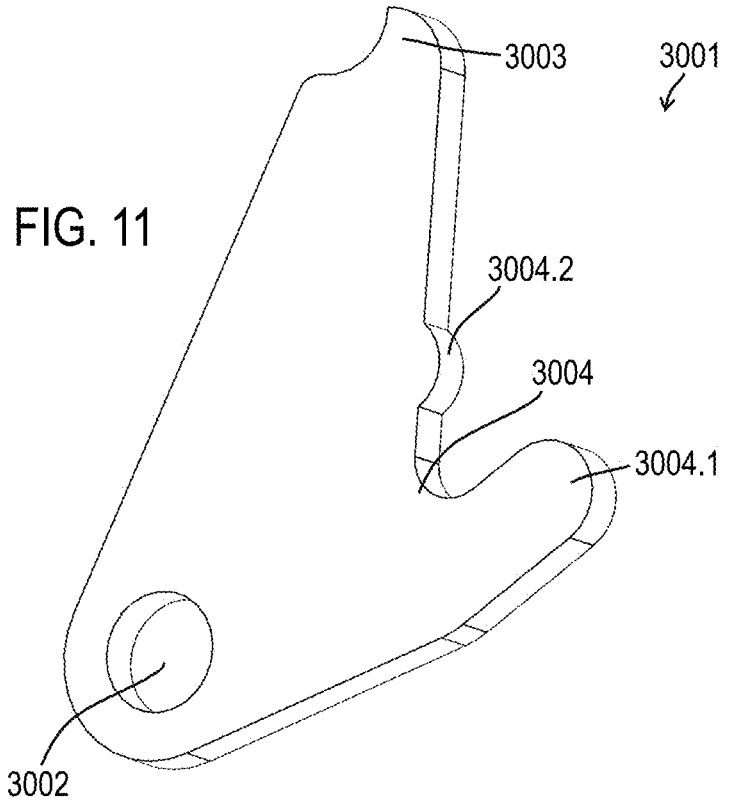
FIG. 11 is a perspective view of a disconnector plate of the operating system of FIG. 7A.

As illustrated in FIG. 11, the disconnector plate 3001 includes a pivot hole 3002, an upper interface portion 3003, and a rear interface portion 3004. As described above, the pivot hole 3002 may be coaxial with pin hole 2005 of the lower member 2001, pivot hole 12.1 of the trigger 12, and pivot hole 14.1 of the disconnector 14. The rear interface portion 3004 may include a lower leg 3004.1 and a protrusion 3004.2. The disconnector plate 3001 may be located adjacent to disconnector 14. In some embodiments, the disconnector plate 3001 is disposed on a left side of the disconnector 14. The disconnector plate 3001 and the disconnector 14 may each interface with the same spring 41, which biases both parts in the counter-clockwise direction, as shown in FIG. 8C. As shown in FIGS. 8A-8C, a portion of the disconnector plate 3001 adjacent to pivot hole 3002 may be disposed within the opening 2003 of the lower member 2001 and a portion (including upper interface portion 3003) of the disconnector plate 3001 may be disposed within the opening 1004 of the pivoting arm 1001. The disconnector plate 3001 may also include a portion adjacent to rear interface portion 3004 that is disposed within the opening 2003 of the lower member 2001.

Figure 12:
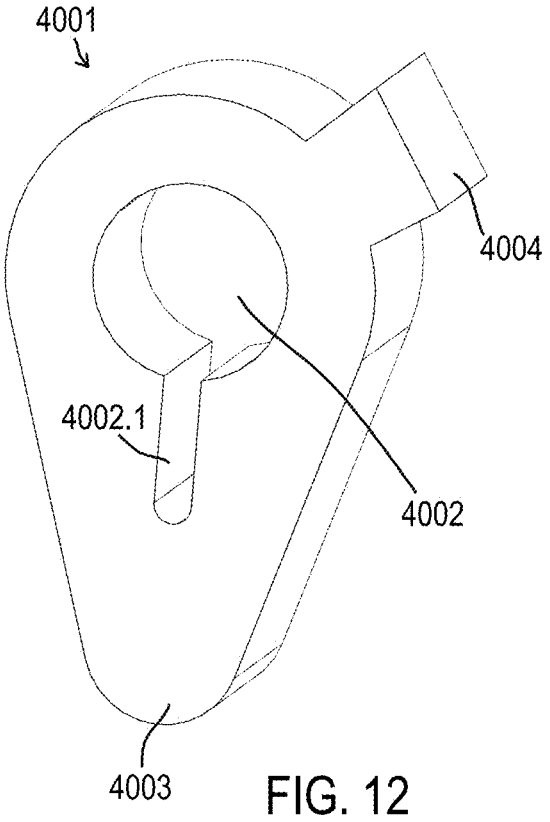
FIG. 12 is a perspective view of a cam of the operating system of FIG. 7A.

The cam 4001 may include a pivot hole 4002, a nose 4003, and a tooth 4004 (see FIG. 12). As described above, the pivot hole 4002 may be coaxial with rotation pin 31, rear pivot hole 2004 of the lower member 2001, and pivot hole 1003 of the pivoting arm 1001. The cam 4001 is at least partially disposed within the opening 1004 of the pivoting arm 1001. In some embodiments, as shown in FIGS. 8A-8C, a majority of (or all of) the cam 4001 is disposed within the opening 2003 of the lower member 2001. The cam 4001 may be disposed adjacent to the disconnector plate 3001. In some examples, the cam 4001 is aligned with the disconnector plate 3001 such that a central plane of the cam 4001 is approximately coplanar with a central plane of the disconnector plate 3001. The nose 4003 may be arranged to interface with the rear interface portion 3004 of the disconnector plate 3001. The cam 4001 may also interface with spring 42 such that a portion of the spring 42 is inserted into slot 4002.1 (see FIGS. 8D and 12).

Figure 13:
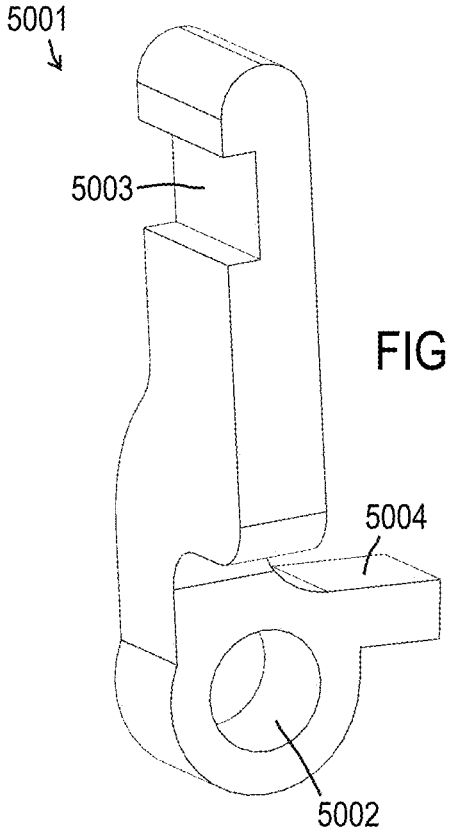
FIG. 13 is a perspective view of a reset arm of the operating system of FIG. 7A.

As illustrated in FIG. 13, the reset arm 5001 may include a pivot hole 5002, a notch 5003, and a rear protrusion 5004. The reset arm 5001 may rotate about pivot hole 5002, which is coaxial with and pivots about pin 33. Pin 33 may extend through the upper portion 12.3 of trigger 12 (see FIGS. 8A-8D). A lower portion of the reset arm 5001 (including the pivot hole 5002 and the rear protrusion 5004) may be disposed within the upper portion 12.3 of trigger 12 while the remaining portions of the reset arm 5001 may extend above the trigger 12. The reset arm 5001 may be disposed adjacent to and on a rear side of the cam 4001. In some examples, the notch 5003 interfaces with the tooth 4004 of the cam 4001 (e.g., see FIGS. 14D and 14E). The reset arm 5001 may also interface with spring 43 such that the spring 43 pushes on an underside of the rear protrusion 5004 to bias the reset arm 5001 in the counter-clockwise direction (as shown in FIG. 8C). In some cases, rotation of the reset arm 5001 is limited where the reset arm 5001 contacts the rear protrusions 1007 of the of the pivoting arm 1001.

Figure 14A:
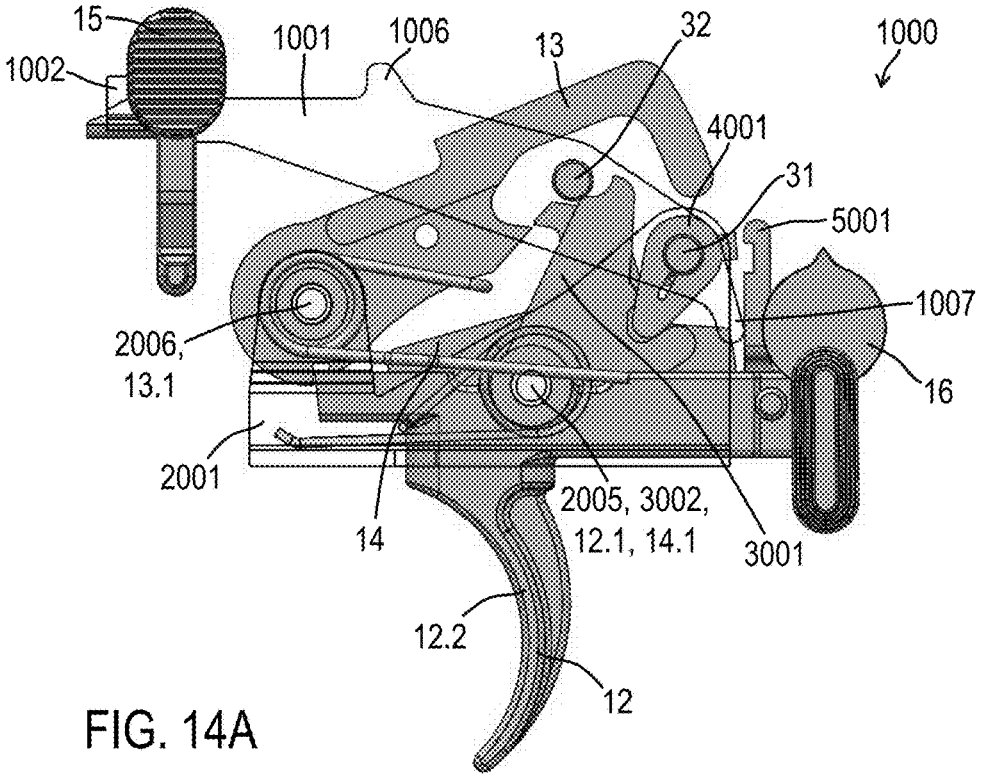
FIG. 14A is a side view of the operating system of FIG. 7A in a first condition.
Figure 14B:
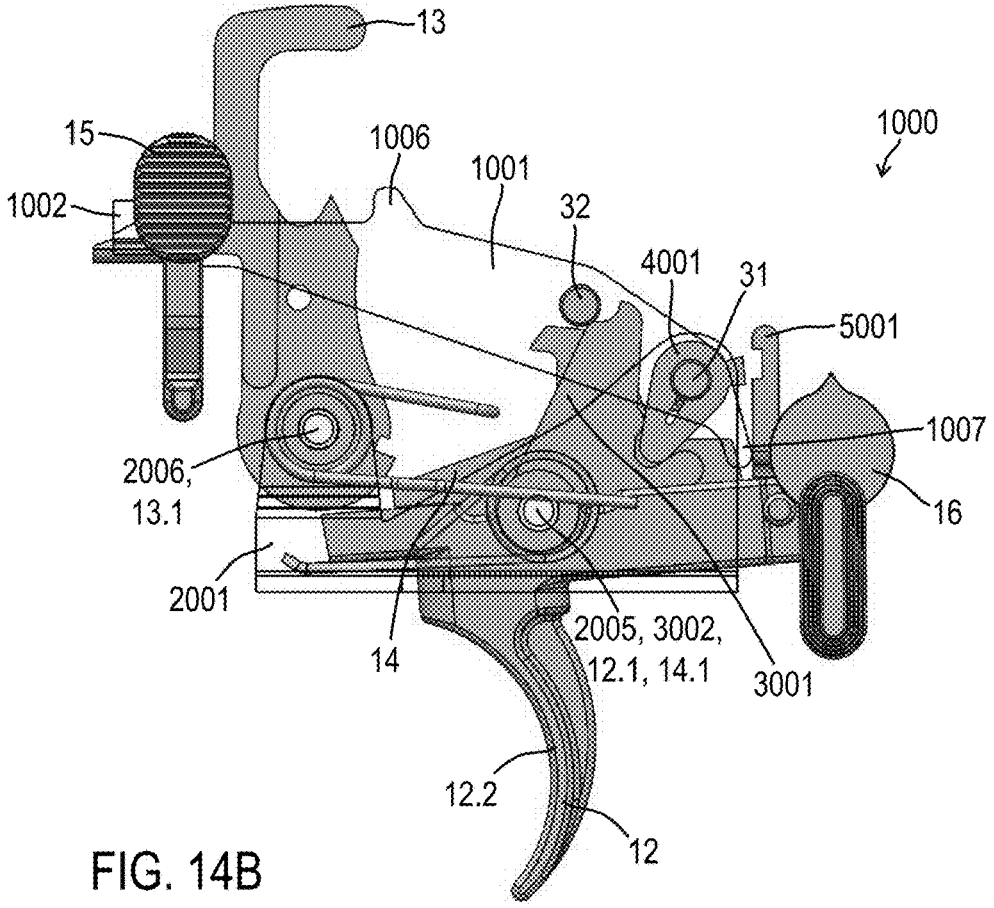
FIG. 14B is a side view of the operating system of FIG. 7A in a second condition.

Various conditions of the operating system 1000 are illustrated in FIGS. 14A-14G, which show a view from the left side of the firearm. In FIG. 14A, the operating system 1000 is in a first condition where (assuming a cartridge is in the chamber, which is not shown) the safety selector 16 is in a fire position and the firearm is ready to fire. As shown in FIG. 14B (second condition) an operator can actuate the trigger 12 by pressing the lower portion 12.2 counter-clockwise about pivot hole 12.1 (as viewed from the left side as shown in FIGS. 14A-14G), which disengages the trigger 12 from the hammer 13 such that the hammer 13 rotates counter-clockwise about pivot hole 13.1 such that the hammer 13 contacts a firing pin (not shown). FIG. 14B shows the operating system 100 at the moment the hammer 13 reaches the forward position (before the bolt carrier group 11 moves rearward). The rotation of the trigger 12 may also rotate (i) the disconnector plate 3001 about pivot hole 3002 and (ii) the disconnector 14 about pivot hole 14.1. The disconnector plate 3001 and the disconnector 14 each move upward closer to pin 32. As shown in FIGS. 14A and 14B, before the pivoting arm 1001 rotates clockwise about rotation pin 31, the rear protrusions 1007 bear against a front face of the reset arm 5001 preventing counter-clockwise motion of the reset arm 5001 (i.e., preventing notch 5003 from engaging the tooth 4004 of the cam 4001).

Figure 14C:
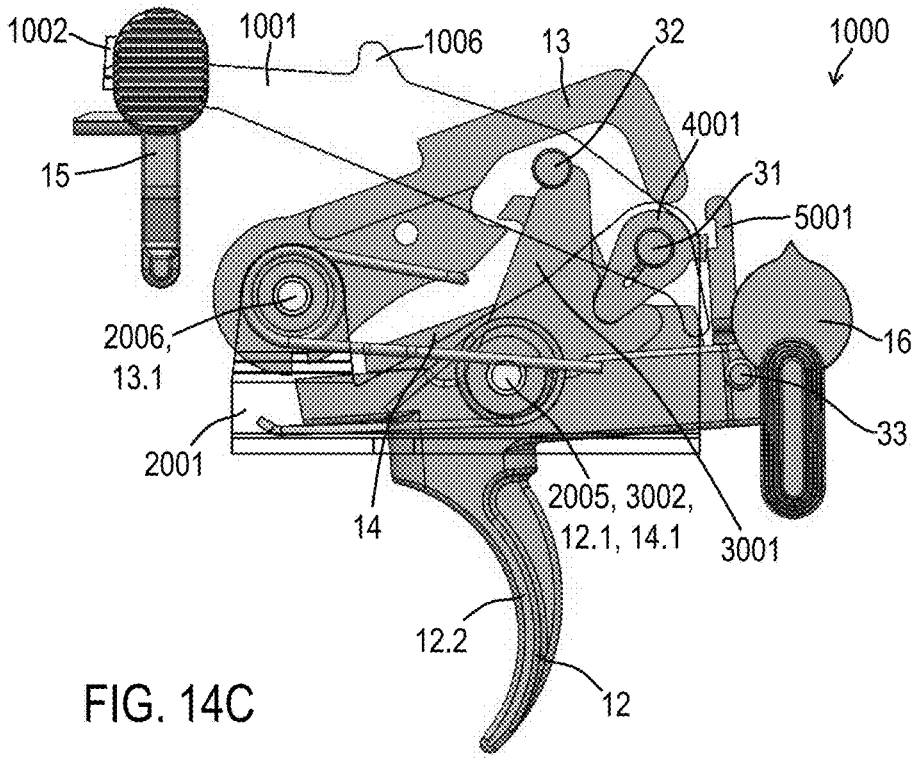
FIG. 14C is a side view of the operating system of FIG. 7A in a third condition.

FIG. 14C shows a third condition immediately after the bolt carrier group 11 has moved to a rear position (due to gas pressure caused by firing a cartridge) such that rearward movement of the bolt carrier group 11 pushes and causes the hammer 13 to rotate about pivot hole 13.1 to a rearward position. In this condition, the upper interface portion 3003 of the disconnector plate 3001 is bearing against the pin 32, which causes the pivoting arm 1001 to rotate clockwise about rotation pin 31. In addition, rotational movement of the cam 4001 (due to spring 42) causes the cam 4001 to bear against protrusion 3004.2 of the disconnector plate 3001, which ensures contact between the upper interface portion 3003 and the pin 32. The cam 4001 rotates clockwise about pivot hole 4002, which causes the disconnector plate 3001 to rotate clockwise. In addition, when the trigger is rotated counter-clockwise, pin 33 move upward, which causes reset arm 5001 to move upward. As shown in FIG. 14C, the notch 5003 of the reset arm 5001 is too high relative to the cam 4001 to engage the tooth 4004. The operating system 1000 may be designed to hold the bolt carrier group 11 in a rear (open) position. In some embodiments, as the bolt carrier group 11 moves rearward, the upward protrusions 1006 contact the underside of the bolt carrier group 11 to ensure the surface 1002.1 of forward protrusion 1002 does not engage any portion of the bolt carrier group 11 other than the leading surface 11.1. Upward pressure on pin 32 causes the pivoting arm 1001 to rotate clockwise about rotation pin 31 such that surface 1002.1 of forward protrusion 1002 interfaces with leading surface 11.1 of the bolt. In other embodiments, the operating system 1000 may engage other portions of the bolt carrier group 11 to secure it in the rear (open) position. FIG. 14C illustrates a condition where movement of the trigger 12 to a rearward position causes the pivoting arm 1001 to pivot upward, engage, and hold the bolt carrier group 11 in the rear (open) position. This is different than a typical conventional firearm where the bolt carrier group 11 would move rearward (due to gas pressure) and immediately return to a forward position.

Figure 14D:
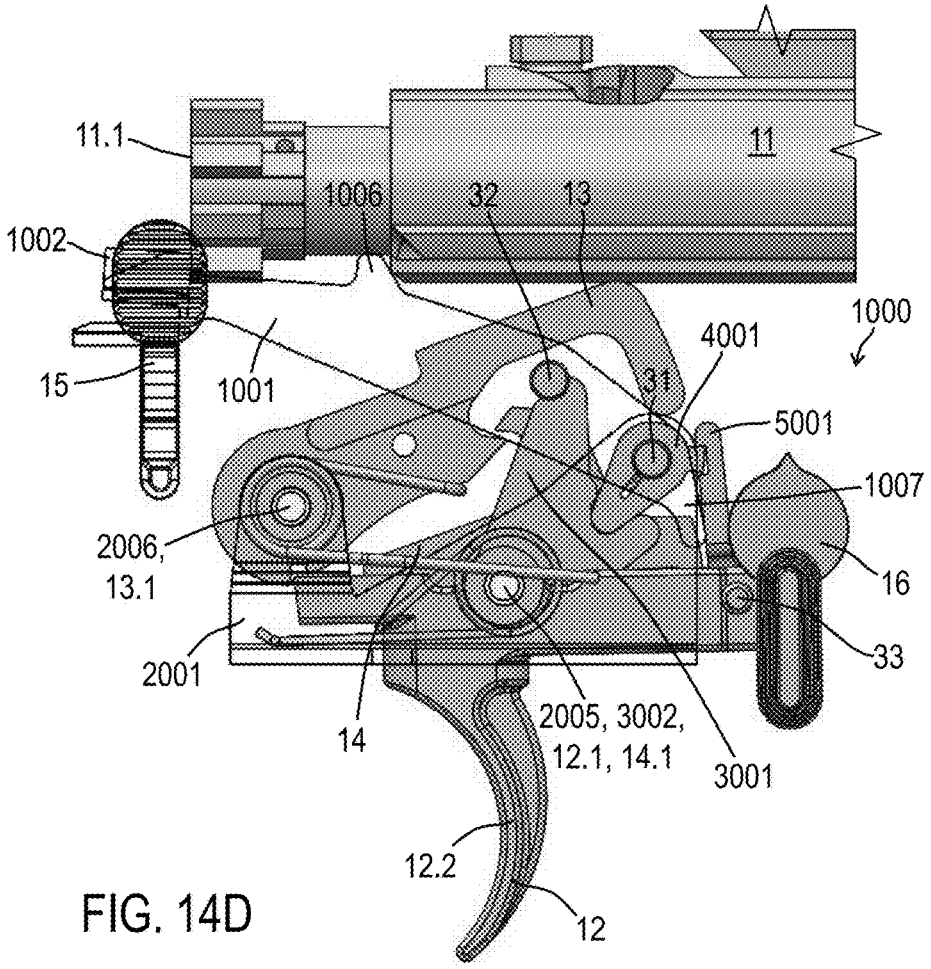
FIG. 14D is a side view of the operating system of FIG. 7A in a fourth condition.

A fourth condition is illustrated in FIG. 14D where trigger 12 has been released and has rotated clockwise about pivot hole 12.1 back toward a typical position. As the trigger rotates clockwise, pin 33 move downward, which causes reset arm 5001 to move downward such that notch 5003 is aligned with tooth 4004. As shown in FIG. 14D, the reset arm 5001 rotates counter-clockwise (due to spring 43) such that notch 5003 engages the tooth 4004. Releasing the trigger would remove pressure on pin 32 and allow the pivoting arm 1001 counter-clockwise about rotation pin 31 and away from the bolt carrier group 11 (e.g., as discussed above for operating system 100). However, engagement between notch 5003 and tooth 4004 prevents rotation of cam 4001, and the interface between the nose 4003 and the rear interface portion 3004 prevents the disconnector plate 3001 from rotating. Holding the disconnector plate 3001 in the position shown in FIGS. 14C and 14D, as discussed above in the context of FIG. 14C, ensures that upper interface portion 3003 maintains upward pressure on the pin 32, which holds the forward protrusion 1002 in an upward position and engages the leading surface 11.1 (or any other relevant portion of the bolt carrier group 11). In other words, the function of operating system 1000 dictates that (starting from condition 1 as shown in FIG. 14A) pivoting the trigger 12 by pressing the lower portion 12.2 counter-clockwise about pivot hole 12.1 causes a round to fire and the bolt carrier group 11 to be retained in a rear (open) position, even after the trigger is released. The trigger 12 (as shown in FIG. 14D) is in a secondary reset position, which is different than a standard position (as shown in FIG. 14A). In other words, the motion of actuating the trigger (e.g., the trigger pull) when moving from the position shown in FIG. 14D is shorter than the motion from the standard position shown in FIG. 14A.

Figure 14E:
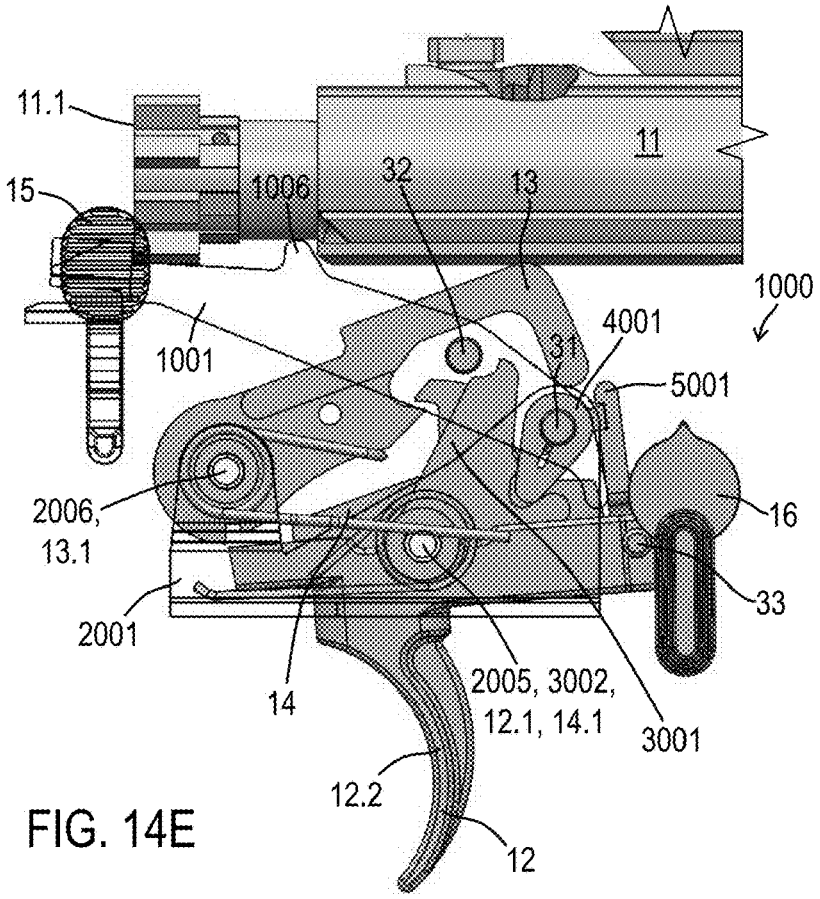
FIG. 14E is a side view of the operating system of FIG. 7A in a fifth condition.

FIG. 14E shows a fifth condition where an operator pivots the trigger 12 by pressing the lower portion 12.2 counter-clockwise about pivot hole 12.1 after starting from the secondary reset position described above in the context of FIG. 14D. In this condition, rotating the trigger 12 counter-clockwise moves pin 33 upward, which causes reset arm 5001 to move upward. The notch 5003 of reset arm 5001 engages tooth 4004 such that the upward movement of the reset arm 5001 causes a counter-clockwise rotation of the cam 4001 about pivot hole 4002. As shown in FIG. 14E, based on the interface between the nose 4003 and the rear interface portion 3004, the counter-clockwise rotation of the cam 4001 causes the disconnector plate 3001 to rotate clockwise about pivot hole 3002. The clockwise rotation of the disconnector plate 3001 moves upper interface portion 3003 away from pin 32, which allows the pivoting arm 1001 to rotate counter-clockwise about rotation pin 31 such that forward protrusion 1002 is free to move down.

Figure 14F:
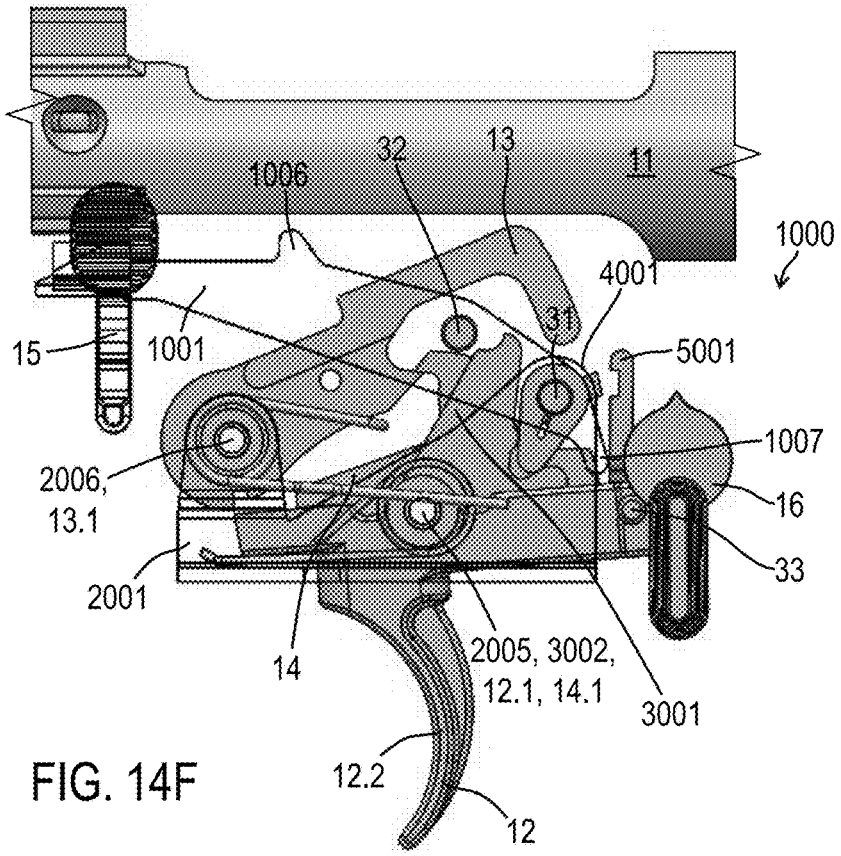
FIG. 14F is a side view of the operating system of FIG. 7A in a sixth condition.

FIG. 14F shows the sixth condition immediately after the fifth condition where the forward protrusion 1002 has moved down thus disengaging from and allowing the bolt carrier group 11 to move forward. The sixth condition shows the lower portion 12.2 of the trigger 12 held in a rearward position As the pivoting arm 1001 rotates down away from the bolt carrier group 11, the rear protrusions 1007 bear against a front face of the reset arm 5001 and rotate the reset arm 5001 clockwise about pivot hole 5002 thus disengaging notch 5003 from the tooth 4004 of the cam 4001. The forward movement of the bolt carrier group 11 allows the hammer 13 to move up (counter-clockwise) slightly until the disconnector 14 engages the hammer. In other words, the function of operating system 1000 dictates that (starting from condition 1 as shown in FIG. 14A) a first trigger actuation (e.g., trigger pull) causes a round to fire, the bolt carrier group 11 to be retained in a rear (open) position (even after the trigger is released), and a second trigger actuation (e.g., trigger pull) causes the bolt carrier group 11 to be released (from the open/rear position) and move to the closed/forward position.

Figure 14G:
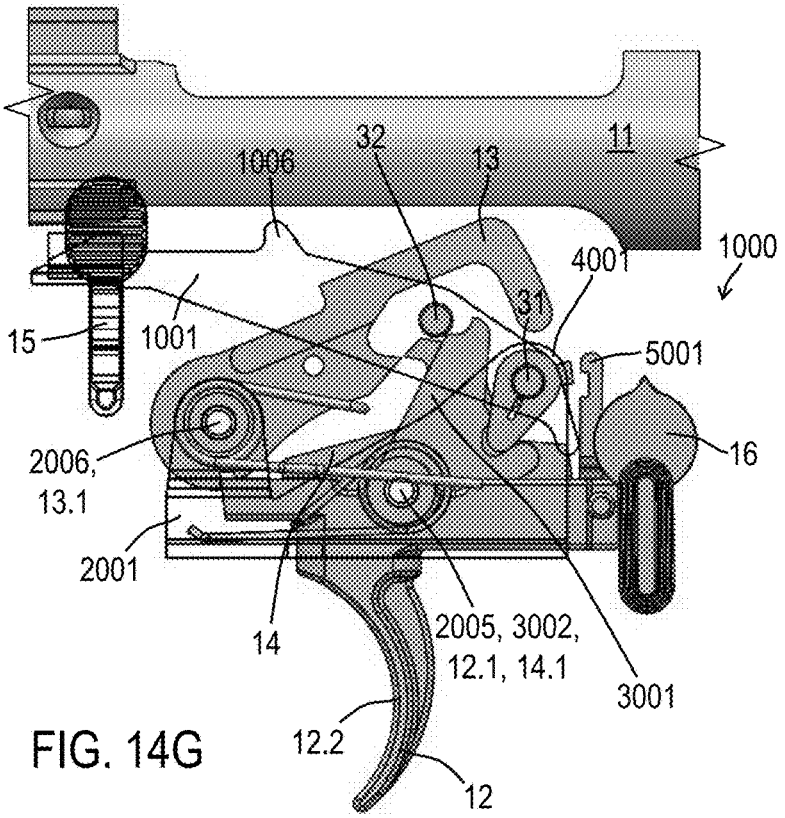
FIG. 14G is a side view of the operating system of FIG. 7A in a seventh condition.

A seventh condition is illustrated in FIG. 14G where the operator has released the trigger 12 allowing the trigger 12 to rotate clockwise about pivot hole 12.1 back to a typical position. Clockwise rotation of the trigger 12 also rotates the disconnector 14 clockwise about pivot hole 14.1 such that the disconnector 14 disengages the hammer 13 allowing the trigger 12 to engage the hammer 13. In other words, FIG. 14G returns the firearm back to a condition similar to FIG. 14A. The firearm is then ready to fire a subsequent round such that the operator may press the lower portion 12.2 causing the trigger 12 to rotate (as described above).

Figure 15:
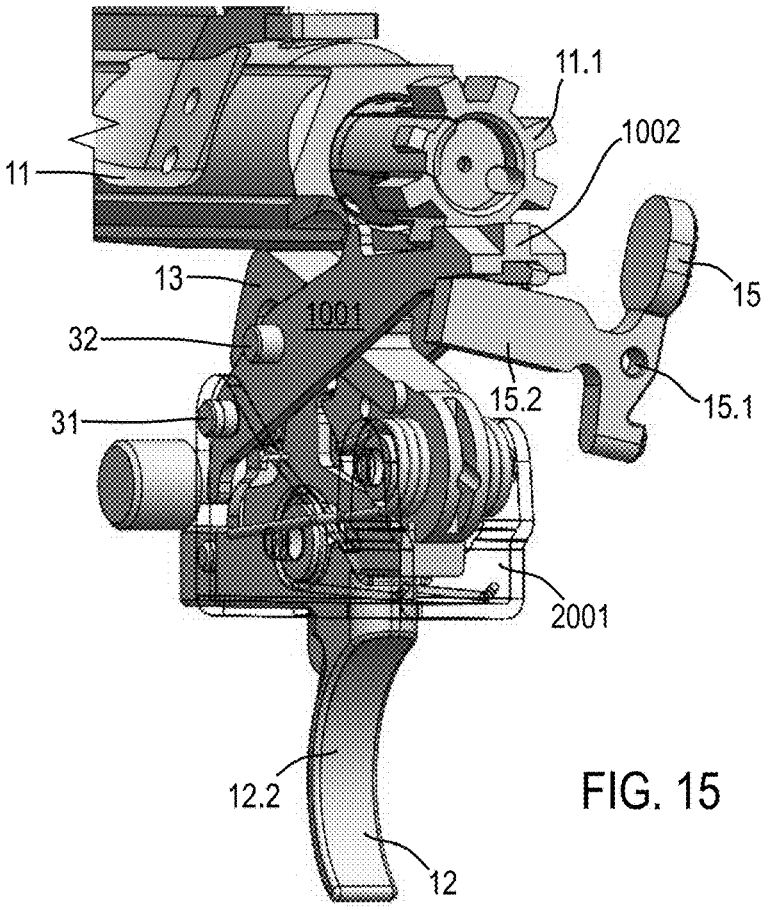
FIG. 15 is a perspective view of the operating system of FIG. 7A.

FIG. 15 shows the interface between the bolt release 15 and the pivoting arm 1001. In some cases, the bolt release 15 is the same as a conventional bolt release while in some cases, the bolt release 15 is modified to interface with the pivoting arm 1001. In some embodiments, to hold the bolt carrier group 11 in a rear/open position, an operator may manually pull the bolt carrier group 11 rearward (using the charging handle) and pivot the bolt release 15 clockwise about hole 15.1 (as shown in FIG. 15). The inner portion 15.2 of the bolt release 15 lifts the forward protrusion 1002 of the pivoting arm 1001 up such that the surface 1002.1 of the forward protrusion 1002 engages the leading surface 11.1 of the bolt. To release the bolt carrier group 11 (i.e., allow the bolt carrier group 11 to move forward to a closed position), the operator would actuate the trigger 12, as described in the context of FIGS. 14D-14E. In addition, in some embodiments, when an operator fires the last round in a magazine, the magazine follower (not shown) engages the bolt release 15 and lifts the inner portion 15.2 lifting the forward protrusion 1002 of the pivoting arm 1001 up such that the surface 1002.1 of the forward protrusion 1002 engages the leading surface 11.1 of the bolt. In other words, some functions of a traditional firearm (e.g., manual bolt hold open and last round bolt hold open) may function in a similar manner for operating system 1000 (or operating system 100) because the bolt release 15 interfaces with the pivoting arm 1001.

The components of the operating system 1000 (or operating system 100) may be formed of one or more materials including, but not limited to, steel, aluminum, stainless steel, high strength aluminum alloy, carbon composite, plastic, thermoplastic, nylon, other plastic or polymer materials, other metallic materials, other composite materials, or other similar materials. Moreover, the components of the operating system 1000 (or operating system 100) may be attached to one another via suitable fasteners, which include, but are not limited to, screws, bolts, rivets, welds, co-molding, overmolding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An operating system disposed within a receiver of a firearm, the operating system comprising:

a trigger comprising a lower portion, an upper portion, and a trigger pivot;

a hammer comprising a hammer pivot;

a disconnector comprising a lower portion, an upper portion, and a disconnector pivot;

a pivoting arm comprising a forward protrusion, and a pin, wherein at least a portion of the hammer and at least a portion of the disconnector are disposed adjacent to the pivoting arm; and a lower member comprising a pin hole that is coaxial with the trigger pivot and the disconnector pivot, wherein at least a portion of the trigger and at least a portion of the disconnector are disposed adjacent to the lower member, wherein motion of the trigger causes the forward protrusion of the pivoting arm to engage a bolt carrier group of the firearm and hold the bolt carrier group in an open position.

2. The operating system of claim 1, wherein:

the pivoting arm comprises an opening; and at least a portion of the hammer and at least a portion of the disconnector are disposed within the opening of the pivoting arm.

3. The operating system of claim 1, wherein the pivoting arm is attached to the lower member by a rotation pin and wherein at least a portion of the pivoting arm is disposed within an opening of the lower member.

4. The operating system of claim 1, wherein motion of the trigger results in pressure on the pivoting arm pin causing the pivoting arm to move upward and engage the bolt carrier group of the firearm.

5. The operating system of claim 4, wherein releasing the trigger causes the pivoting arm to move downward and disengage the bolt carrier group of the firearm.

6. The operating system of claim 4, wherein a subsequent trigger actuation causes the pivoting arm to move downward and disengage the bolt carrier group of the firearm.

7. The operating system of claim 1, further comprising a disconnector plate, a cam, and a reset arm, wherein:

the disconnector plate is disposed adjacent to the disconnector and comprises a pivot hole that is coaxial with the trigger pivot and the disconnector pivot;

the cam comprises (i) a nose that interfaces with a rear interface portion of the disconnector plate and (ii) a cam pivot that is coaxial with a pin connection between the pivoting arm and the lower member; and the reset arm comprises a notch that interfaces with a tooth of the cam.

8. The operating system of claim 1, wherein the hammer pivot is coaxial with a forward pivot hole of the lower member.

9. The operating system of claim 1, wherein the forward protrusion of the pivoting arm interfaces with a bolt release of the firearm.

10. The operating system of claim 1, wherein the pivoting arm comprises at least one upward protrusion, wherein the at least one upward protrusion is configured to contact an underside of the bolt carrier group of the firearm.

11. An operating system disposed within a receiver of a firearm, the operating system comprising:

a trigger comprising a lower portion, an upper portion, and a trigger pivot;

a hammer comprising a hammer pivot;

a disconnector comprising a lower portion, an upper portion, and a disconnector pivot; and a pivoting arm comprising a forward protrusion and a pin, wherein:

motion of the trigger causes the forward protrusion of the pivoting arm to engage a bolt carrier group of the firearm and hold the bolt carrier group in an open position.

12. The operating system of claim 11, further comprising a lower member that is pivotably attached to the pivoting arm.

13. The operating system of claim 11, wherein:

the pivoting arm comprises an opening; and at least a portion of the hammer and at least a portion of the disconnector are disposed within the opening of the pivoting arm.

14. The operating system of claim 11, wherein motion of the trigger results in pressure on the pivoting arm pin causing the pivoting arm to move upward and engage the bolt carrier group of the firearm.

15. The operating system of claim 14, wherein releasing the trigger causes the pivoting arm to move downward and disengage the bolt carrier group of the firearm.

16. The operating system of claim 14, wherein a subsequent trigger actuation causes the pivoting arm to move downward and disengage the bolt carrier group of the firearm.

17. The operating system of claim 11, further comprising a disconnector plate, a cam, and a reset arm, wherein:

the disconnector plate is disposed adjacent to the disconnector and comprises a pivot hole that is coaxial with the trigger pivot and the disconnector pivot;

the cam comprises (i) a nose that interfaces with a rear interface portion of the disconnector plate and (ii) a cam pivot that is coaxial with a pin connection of the pivoting arm; and the reset arm comprises a notch that interfaces with a tooth of the cam.

18. The operating system of claim 12, wherein the hammer pivot is coaxial with a forward pivot hole of the lower member.

19. The operating system of claim 11, wherein the forward protrusion of the pivoting arm interfaces with a bolt release of the firearm.

20. The operating system of claim 11, wherein the pivoting arm comprises at least one upward protrusion, wherein the at least one upward protrusion is configured to contact an underside of the bolt carrier group of the firearm.

* * * * *